US012806491B2

(12) United States Patent
Li

(10) Patent No.: US 12,806,491 B2
(45) **Date of Patent: *Nov. 24, 2026**

(54) PICKLEBALL PADDLE WITH REINFORCED CORE

(71) Applicant: Ronbus Corporation, Lexington, KY (US)

(72) Inventor: Dong Li, Lexington, KY (US)

( * ) Notice: Subject to any disclaimer, the term of this patent is extended or adjusted under 35 U.S.C. 154(b) by 211 days.

This patent is subject to a terminal disclaimer.

(21) Appl. No.: 18/825,473

(22) Filed: Sep. 5, 2024

(65) Prior Publication Data

US 2024/0424366 A1 Dec. 26, 2024

Related U.S. Application Data

(63) Continuation-in-part of application No. PCT/US2023/080521, filed on Nov. 20, 2023.
(Continued)

(51) Int. Cl.
*A63B 59/42* (2015.01)
*A63B 102/08* (2015.01)

(52) U.S. Cl.
CPC ..... *A63B 59/42* (2015.10); *A63B 2102/08* (2015.10); *A63B 2209/023* (2013.01)

(58) Field of Classification Search
CPC ..... A63B 59/42; A63B 2102/08; A63B 2209/023; A63B 59/48; A63B 2209/00; A63B 2209/02
See application file for complete search history.

(56) References Cited

U.S. PATENT DOCUMENTS 3,879,035 A 4/1975 Danchulis et al.
7,867,428 B2 1/2011 Filippini
(Continued)

FOREIGN PATENT DOCUMENTS

CN 108579035 A 9/2018
CN 216653316 U 6/2022
(Continued)

OTHER PUBLICATIONS

International Search Report and Written Opinion for PCT/US2023/080521 dated Nov. 14, 2023.
(Continued)

*Primary Examiner* — Jeffrey D Carlson
(74) *Attorney, Agent, or Firm* — Shore IP Group, PLLC; Paul J. Natof

(57) ABSTRACT

A pickleball paddle including a handle portion and a head portion is disclosed. The head portion is operably connected to the handle portion and includes a core portion, a first layer, a second layer, and a reinforcing member. The core portion includes a plurality of strips. At least one strip of the plurality of strips has a cross-section that is a rectangle. The core portion defines an edge, a first surface, and a second surface. The first layer is disposed adjacent the first surface of the core portion, and is made from a first material. The second layer is disposed adjacent the second surface of the core portion, and is made from the first material. The reinforcing member is disposed within the core portion and in contact with the first layer and the second layer. The reinforcing member includes a grid structure defining a plurality of open spaces.

20 Claims, 16 Drawing Sheets

Related U.S. Application Data

(60) Provisional application No. 63/435,317, filed on Dec. 26, 2022, provisional application No. 63/385,015, filed on Nov. 26, 2022, provisional application No. 63/384,980, filed on Nov. 25, 2022.

(56) References Cited

U.S. PATENT DOCUMENTS

| | | | | |
|---|---|---|---|---|
| 10,377,093 | B2 | 8/2019 | Filippini | |
| 11,046,037 | B2 | 6/2021 | Filippini | |
| 11,597,169 | B2 | 3/2023 | Simmons | |
| 11,707,898 | B2 | 7/2023 | Filippini | |
| 2016/0193793 | A1* | 7/2016 | Filippini | B29D 99/0014 264/138 |
| 2017/0021248 | A1 | 1/2017 | Marvin | |
| 2018/0104555 | A1 | 4/2018 | Taylor | |
| 2021/0252356 | A1 | 8/2021 | Thurman et al. | |
| 2022/0032141 | A1 | 2/2022 | Brents et al. | |
| 2022/0040937 | A1* | 2/2022 | Simmons | B29C 70/68 |
| 2022/0088449 | A1 | 3/2022 | Marshall | |
| 2024/0017141 | A1 | 1/2024 | Filippini | |
| 2024/0066371 | A1 | 2/2024 | Filippini | |

FOREIGN PATENT DOCUMENTS

| | | | |
|---|---|---|---|
| CN | 117379763 | A | 1/2024 |
| WO | 2022182922 | A1 | 9/2022 |
| WO | 2024076417 | A1 | 4/2024 |

OTHER PUBLICATIONS

International Preliminary Report on Patentability and Written Opinion for application No. PCT/US2023/080521 dated Jun. 5, 2025, 8 pages.

* cited by examiner

PICKLEBALL PADDLE WITH REINFORCED CORE

CROSS-REFERENCE TO RELATED APPLICATIONS

The present application is a continuation-in-part of International Patent Application No. PCT/US2023/080521, filed on Nov. 20, 2023, which claims the benefit of and priority to U.S. Provisional Patent Application Ser. No. 63/435,317, filed on Dec. 26, 2022, U.S. Provisional Patent Application Ser. No. 63/385,015, filed on Nov. 26, 2022, and U.S. Provisional Patent Application Ser. No. 63/384,980, filed on Nov. 25, 2022, the entire contents of each of which are incorporated herein by reference.

BACKGROUND

The present disclosure relates to a pickleball paddle. More particularly, the disclosure relates to a pickleball paddle having a reinforced core.

Pickleball has gained in popularity over the past several years and is played in countries around the world. Pickleball games are played both indoors and outdoors, and are played using a paddle and a plastic ball.

For sanctioned games, USA Pickleball ("USAP") requires the combined length and width of the paddle to not exceed 24 inches, and the length cannot exceed 17 inches. While there are currently no requirements regarding thickness or weight of the paddle, the surface of the paddle is not permitted to include holes or indentations. Additionally, the USAP requires that the paddles have a specific range of rigidity. To meet the USAP rigidity specifications, paddle deflection cannot exceed 0.005 inches when a force of 3 kg is applied to the center of the paddle.

Many advanced pickleball paddles are structured with a semi-rigid interior core between two flat surfaces. The interior core of the paddle is made of materials such as Nomex or Polypropylene, shaped into a honeycomb configuration. The outer surface may be a carbon fiber skin. The shape of the paddle may be cut from a panel having the interior core sandwiched between top and bottom outer surfaces.

The core edges are exposed with a gap between the top and bottom surfaces when the panel is cut into the shape of the paddle. A plastic edge guard may be placed around the paddle frame to close the gap between the top and bottom surfaces and to protect the paddle edge.

Some pickleball players find it helpful to cause the ball to spin when hitting the ball with the paddle. Two types of spin that are used in pickleball play are topspin and underspin or backspin. Topspin is generated by the forward rotation of the ball, and underspin/backspin is generated by the backward rotation of the ball. To hit a ball with topspin, a player rotates the head of the paddle over the top of the ball as the paddle contacts the ball. This exerts a torque about the center of the ball that causes the ball to rotate with a forward spin during its flight. Hitting a ball with topspin causes a Magnus force to act on the ball perpendicular to the velocity of the ball in the downward direction. Because there is an additional downward force on the ball, pickleball players can use topspin to hit the ball harder with greater speed, and the ball may still land in bounds, therefore providing more consistency in the shots. In addition, balls hit with topspin can be hit higher above the net while still staying in bounds, making the shot more difficult to return. This also results in a higher bounce for the ball after landing.

To hit a ball with underspin or backspin, a player angles their paddle back and slides the paddle underneath the ball when hitting the ball. This type of shot is also called a slice. It exerts a torque about the center of the ball that causes the ball to rotate with a backward spin during its flight. Hitting a ball with underspin causes a Magnus force to act on the ball perpendicular to the velocity of the ball in the upward direction. Because there is an additional upward force on the ball, the ball seems to "float" through the air as it flies. Slice shots are thus generally hit low over the net and with a relatively slow speed to help prevent the ball from going out of the bounds of the court. This results in a lower bounce for the ball. In addition, slicing the ball may allow the player to more easily hit the ball to a precise location in the opponent's court.

There are different ways the pickleball paddle itself can help generating spin during pickleball play. One way is to leverage or increase the surface friction generated when the ball hits the paddle surface. Grit paint or coatings can be used to make the hitting surface of the paddle gritty. However, grit paint and coatings wear off relatively quickly and these types of surfaces become smooth after a short playing period such that the spin capability of the paddle degrades quickly.

Some paddles use high grade raw carbon fiber (such as T700 carbon fiber) as a surface material, and/or an extra layer of fabric material known as peel ply. While these methods typically last longer than grit or painted coatings, they will still wear over time and/or are often prohibitively expensive.

Another way to generate spin using a pickleball paddle is to utilize the compression of the paddle when striking a ball. For paddles having a non-textured finish, the entire paddle structure is typically important. If the paddle is too rigid it will make the paddle less efficient at spinning the ball. On the other hand, a softer paddle can still provide huge amounts of spin even without having a textured paddle surface. A sufficient amount of compression of the hitting surface and the paddle structure underneath can generate a lot of spin. The amount of compression may depend on the surface material of the paddle, the core material of the paddle, and/or the entire structure of the paddle.

In classical mechanics, impulse (J) is the integral of a force (F) divided by the time interval (t) for which it acts. Since force is a vector quantity, impulse is also a vector quantity. Impulse applied to an object produces an equivalent vector change in its linear momentum, also in the resultant direction. A resultant force applied over a longer time, therefore, produces a bigger change in linear momentum than the same force applied briefly.

When a pickleball paddle makes contact with a ball, the force of the paddle on the ball delivers an impulse to the ball while the ball is in contact with the paddle. The magnitude of the force of the paddle on the ball varies with time, starting low at initial contact, then reaching a maximum when the ball compression and the deformity of the paddle surface reaches a maximum, before reducing back to zero as the ball leaves the surface of the paddle. A relatively clastic paddle exerts a strong restoring force on a ball when the ball impacts the paddle, which helps add to the impulse delivered to a ball when the ball is hit by the paddle. Various levels of elasticity of the paddle structure will produce different levels of spin capability.

A pickleball paddle that provides the sense or feel of an increased contact time between the paddle and the ball upon impact, or "dwell time," is often desired. The increased dwell time improves not only the responsiveness of the paddle, but also the ability of the paddle to generate spin on the ball.

Many current pickleball paddles have a polypropylene honeycomb core. When a ball hits the surface of such a paddle, the honeycomb core does not generate much compression. This results in less "dwell time" between the paddle and the ball, which results in a relatively low amount of spin that is generated. A pickleball paddle that offers improved performance such as increased power and spin may be desired by some players. Maximizing "dwell time" while still conforming to the USAP rigidity specifications can be particularly challenging when designing a pickleball paddle.

SUMMARY

The present disclosure relates to a pickleball paddle. The pickleball paddle includes a handle portion and a head portion operably connected to the handle portion. The head portion includes a core portion, a first layer, a second layer, and a reinforcing member. The core portion includes a plurality of strips. At least one strip of the plurality of strips has a cross-section that is a rectangle. The core portion defines an edge, a first surface, and a second surface. The first layer is disposed adjacent the first surface of the core portion, and is made from a first material. The second layer is disposed adjacent the second surface of the core portion, and is made from the first material. The reinforcing member is disposed within the core portion and in contact with the first layer and the second layer. The reinforcing member includes a grid structure defining a plurality of open spaces.

In disclosed embodiments, the core portion includes foam disposed within the plurality of open spaces defined by the reinforcing member.

In disclosed embodiments, a first section of the reinforcing member is oriented at a perpendicular angle relative to the first layer.

In disclosed embodiments, the core portion includes foam. The foam on a first side of the reinforcing member is in direct contact with foam on a second side of the reinforcing member.

In disclosed embodiments, the reinforcing member is made from a fiber-reinforced composite.

In disclosed embodiments, the grid structure forma at least one of a plurality of polygons or a plurality of round shapes.

In disclosed embodiments, each strip of the plurality of strips has a cross-section that is a rectangle.

In disclosed embodiments, the cross-section of the at least one strip is taken along a width of the head portion in a direction that is perpendicular to the handle portion.

In disclosed embodiments, the least one strip of the plurality of strips has a cross-section that is a rectangle defines four walls. The reinforcing member is disposed in contact with each wall of the four walls of the at least one strip of the plurality of strips.

In disclosed embodiments, the first material is a fiber-reinforced composite.

In disclosed embodiments, the pickleball paddle includes an edge tube disposed along a perimeter of the head portion. The edge tube includes a sleeve at least partially surrounding foam. The sleeve is made from fiber-reinforced composite.

In disclosed embodiments, the pickleball paddle includes an edge portion disposed along a perimeter of the head portion. The edge portion includes an edge grid structure made from a fiber-reinforced composite at least partially surrounding foam.

In disclosed embodiments, the plurality of strips includes between three strips and sixteen strips.

In disclosed embodiments, the head portion includes an interconnect member extending between and in contact with the first layer and the second layer, and extending between and in contact with two strips of the plurality of strips.

In disclosed embodiments, the interconnect member is made from a foam material.

The present disclosure also relates to a head portion of a pickleball paddle. The head portion includes a core portion, a first layer, a second layer, and a reinforcing member. The core portion includes a plurality of rectangular prisms. The first layer is disposed in contact with a first surface of at least one rectangular prism of the plurality of rectangular prisms. The first layer is made from a first material. The second layer is disposed in contact with a second surface of the at least one rectangular prism of the plurality of rectangular prisms. The second layer is made from the first material. The reinforcing member is disposed in contact with the first layer, the second layer, and with each rectangular prism of the plurality of rectangular prisms. The reinforcing member includes a grid structure defining a plurality of open spaces.

In disclosed embodiments, each rectangular prism of the plurality of rectangular prisms is made from foam.

In disclosed embodiments, the reinforcing member is made from a fiber-reinforced composite.

In disclosed embodiments, the plurality of rectangular prisms includes between three rectangular prisms and sixteen rectangular prisms.

In disclosed embodiments, the reinforcing member is in contact with each of the four sides of each rectangular prism of the plurality of rectangular prisms.

BRIEF DESCRIPTION OF THE DRAWINGS

Embodiments of the present disclosure are described hereinbelow with reference to the drawings wherein.

DETAILED DESCRIPTION

Figure 1:
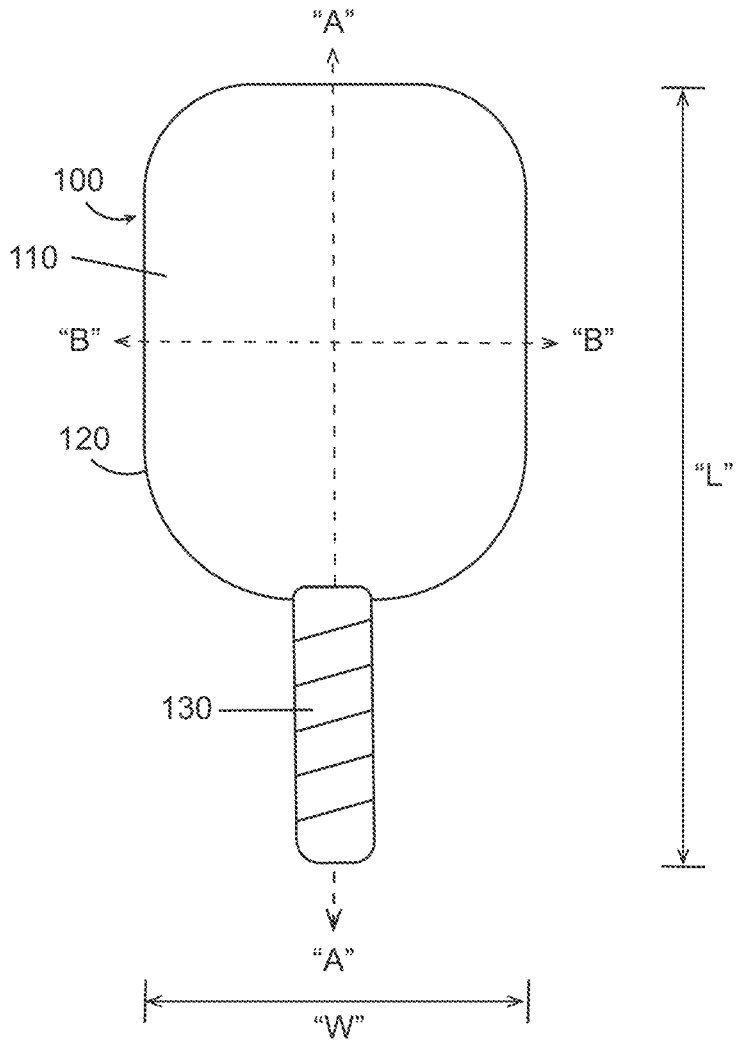
FIG. 1 is a front view of a pickleball paddle in accordance with embodiments of the present disclosure.

Embodiments of the presently disclosed pickleball paddle and components thereof are now described in detail with reference to the drawings, in which like reference numerals designate identical or corresponding elements in each of the several views.

In general, the embodiments of pickleball paddles described herein may result in higher absorption of the impact energy of the ball hitting the pickleball paddle, increased duration of the ball in contact with the pickleball paddle, and/or greater angular momentum imparted on the ball when the pickleball paddle rolls over or under the ball.

Various embodiments of pickleball paddles (or "paddles") are shown in the accompanying figures, and are generally referenced by numeral 100. As shown in FIG. 1, the paddle 100 includes a head portion 110 coupled to a handle portion 130. Generally, the length "L" of the paddle 100 may be between 15 inches and 17 inches, and the combined length plus width "W" of the paddle 100 does not exceed 24 inches. The present disclosure also contemplates paddles 100 having larger and/or smaller dimensions for the length "L" and width "W." Additionally, while the head portion 110 is shown having a rectangular shape with rounded corners, a head portion 110 having other shapes, such as oval, isometric, round, teardrop, for example, is encompassed by the present disclosure. With continued reference to FIG. 1, the paddle 100 defines a longitudinal axis "A-A" extending through the handle portion 130, and a latitudinal axis "B-B" extending perpendicularly to the longitudinal axis "A-A."

Referring now to FIGS. 2A-3B, schematic cross-sectional views of a portion of the head portion 110 of the paddle 100 of FIG. 1 are shown in accordance with various embodiments of the present disclosure. Here, the head portion 110 of the paddle 100 includes a first or top layer 112, a second or bottom layer 118, a core portion 115, and an edge portion 120. In embodiments, the thickness "t" (see FIG. 2A) of the head portion 110, measured between an upper surface 111 of the first layer 112 and a lower surface 119 of the second layer 118, is between about 10 mm and about 20 mm. Additionally, the head portion 110 can define a thickness "t" that is greater than or less than this range without departing from the scope of the present disclosure.

The core portion 115 of the paddle 100 can be made from any suitable material that can recover its initial shape after impact, such as foam (e.g., elastomeric foam). For instance, the foam of the core portion 115 can be open-celled (e.g., Polyurethane or "PU", natural rubber or "NR", nitrile, Ethylene-Propylene-Diene Monomer or "EPDM", Polyvinyl Chloride or "PVC", etc.) or closed-celled (e.g., Ethyl-Vinyl Acetate or "EVA", neoprene, Styrene-Butadiene Rubber or "SBR", etc.). The foam may also be thermoplastic or thermoset. Further, the core portion 115 can be made from any combination of the disclosed materials or other materials, and may include a multi-layer structure.

Various embodiments of the core portion 115 and the edge portion 120 of the paddle 100 are shown in the accompanying figures. While certain combinations of the different embodiments of the core portion 115 and the edge portion 120 are shown, other combinations are also encompassed by the present disclosure.

Additionally, while it is contemplated that embodiments of the paddle 100 include the first layer 112 being different from the second layer 118, the embodiments described herein include each paddle 100 having the first layer 112 being the same as the second layer 118. For clarity, when one of the first layer 112 or the second layer 118 is described herein with regard to a particular embodiment, the other of the first layer 112 or the second layer 118 in the same embodiment is identical or substantially identical.

Generally, the first layer 112, the second layer 118 and the core portion 115 form a sandwiched structure.

In each of the embodiments shown in FIGS. 2A-3B, the first layer 112 includes the outer surface 111 and an inner surface 113, and the second layer 118 includes the outer surface 119 and an inner surface 117. In embodiments, each of the first layer 112 and the second layer 118 is made from a woven or non-woven composite fiber material including fibers impregnated with resin, such as epoxy, polyester, and/or metal matrix resins. For instance, the material may include any fiber-reinforced composite (including fiber-reinforced polymers, fiber-reinforced plastics, etc.). Additionally, the material of each of the first layer 112 and the second layer 118 can include multiple layers of material (e.g., where adjacent layers include 45°, 90°, etc. offset grain orientation, for instance).

In disclosed embodiments, the outer surfaces 111, 119 of the respective first layer 112 and the second layer 118 have a roughened texture. The roughened texture can be formed by grit, sand, and/or other particles applied to, or positioned under one or more coatings applied to the outer surfaces 111, 119.

Another way of forming a roughened texture is by applying an additional layer of a fabric material, such as a peel ply fabric, on the outer surfaces 111, 119. In embodiments, the peel ply fabric is a woven fabric, nylon, or polyester, which, during the cure cycle of the manufacturing process, absorbs some of the matrix epoxy resin, for instance, and becomes an integral part of the laminate of each layer 112, 118. Following the cure cycle, the peel ply fabric is peeled off or otherwise removed from the first layer 112 and the second layer 118, which fractures the resin between the peel ply fabric and the outer surfaces 111, 119, respectively, and which leaves a fresh, clean, roughened surface of matrix epoxy resin. A further way of forming a roughened texture is by making the outer surfaces 111, 119 from woven, high-grade raw carbon fiber, other fibrous materials, and/or combinations thereof.

In disclosed embodiments, a ply of planar fiber material is first cut into the shape of the mold corresponding to the shape of the pickleball paddle 100. The fibers can be co-axially aligned in sheets or layers, braided, or weaved in sheets or layers, and/or chopped and randomly dispersed in one or more layers. In a multiple layer construction, the fibers can be aligned in different directions with respect to the longitudinal axis "A-A" of the paddle 100, and/or in braids or weaves from layer to layer. The fibers may be formed of a high tensile strength material such as carbon (e.g., T700, T800, 3K, 6K, 12K or 18K carbon fiber). Alternatively, the fibers can be formed of other materials such as glass, graphite, Zylon, Nylon, Aramid, Arylate, Kevlar®, graphene, boron and combinations thereof. Further, any suitable fiber-reinforced composite can be used.

A roughened texture on the outer surfaces 111, 119 may be useful to some pickleball players by generating a relatively large amount of friction (as opposed to a smooth surface) may making contact with the ball. This roughened texture and increased friction can help a player generate spin, and create an increased amount of angular momentum resulting in the ball travelling with higher angular velocities.

Alternatively, the outer surfaces 111, 119 of the paddle 100 can be smooth, and not roughened or textured, which may be preferred by some players.

Figure 9A:
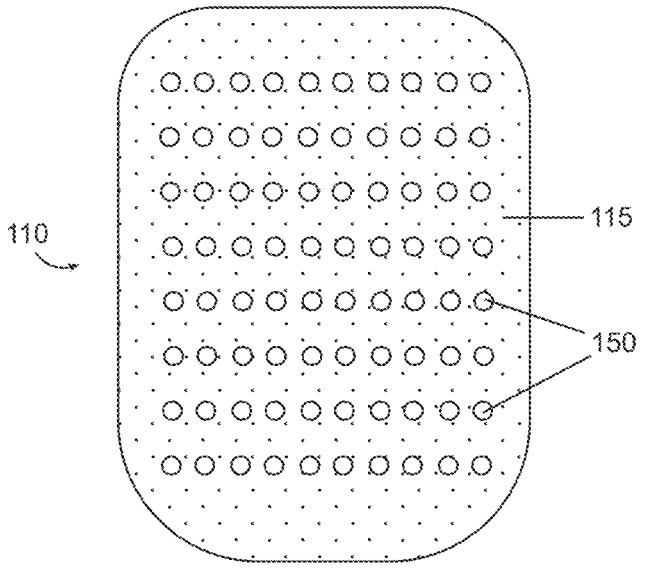
FIG. 9A is a top view of an embodiment of a head of the pickleball paddle of FIG. 1 in accordance with an embodiment of the present disclosure.
Figure 9B:
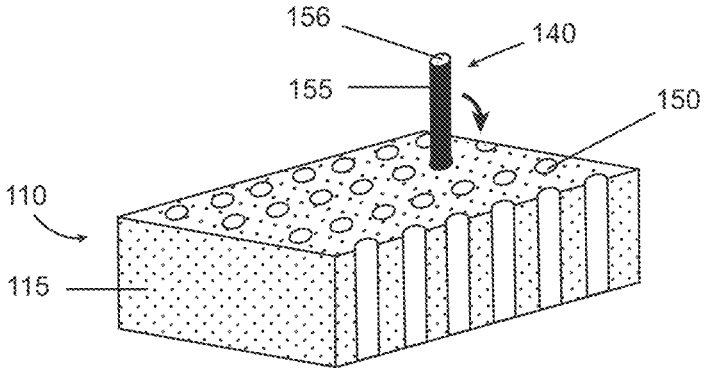
FIG. 9B is a perspective view of a portion of the head of the pickleball paddle of FIG. 9A illustrating the insertion of a cylindrical reinforcing member.
Figure 9C:
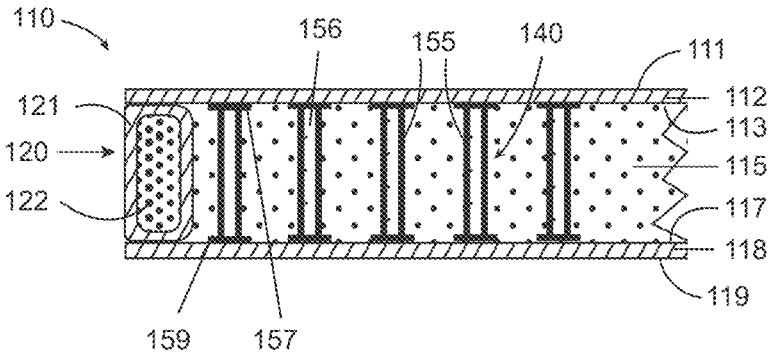
FIG. 9C is a schematic, cross-sectional view of the head of the pickleball paddle of FIGS. 9A and 9B including a plurality of cylindrical reinforcing members taken along line B-B in FIG. 1.
Figure 10A:
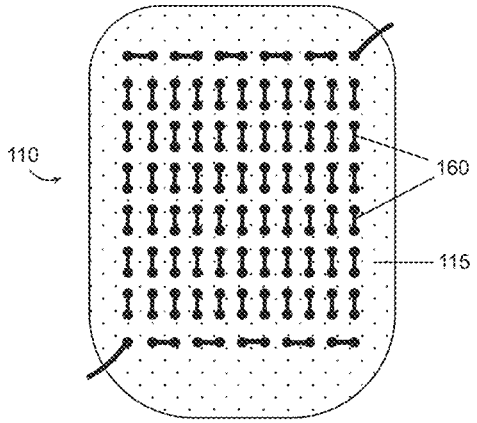
FIGS. 10A and 10B are top views of a head of the pickleball paddle of FIG. 1, illustrating an extended thread portion, in accordance with embodiments of the present disclosure.
Figure 10B:
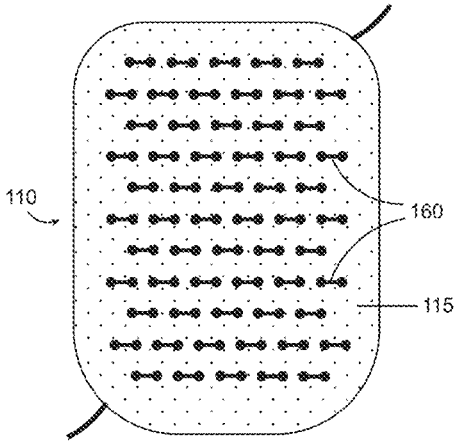
Figure 10C:
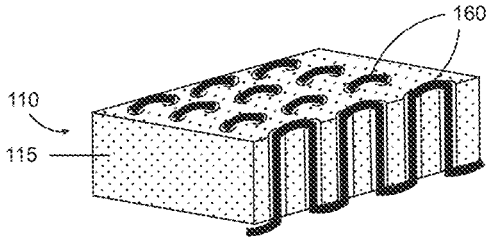
FIG. 10C is a perspective view of a portion of the head of the pickleball paddle of FIGS. 10A and 10B.
Figure 10D:
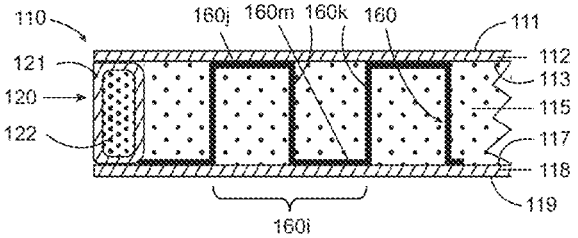
FIG. 10D is a schematic, cross-sectional view of the head of the pickleball paddle of FIGS. 10A-10C taken along line B-B in FIG. 1.

With continued reference to FIGS. 2A-3B and with additional reference to FIGS. 9C and 10D, the edge portion 120 of the paddle 100 is shown. An edge foam 122 is positioned within an edge tube 121, which extends along the perimeter of the head portion 110 of the pickleball paddle 100. The edge tube 121 interconnects the first layer 112 and the second layer 118, and may be made from a fiber-reinforced composite, such as the same material that the first layer 112 and the second layer 118 are made from. The edge foam 122 is at least partially encapsulated by the edge tube 121 and is made from either the same material used to make the core portion 115, or from a different material. For instance, the edge foam 122 can be open-celled (e.g., Polyurethane or "PU", natural rubber or "NR", nitrile, Ethylene-Propylene-Diene Monomer or "EPDM", Polyvinyl Chloride or "PVC", etc.) or closed-celled (e.g., Ethyl-Vinyl Acetate or "EVA", neoprene, Styrene-Butadiene Rubber or "SBR", etc.). The edge foam 122 may also be thermoplastic or thermoset.

In embodiments, the edge foam 122 cures within the edge tube 121, thereby allowing the edge tube 121 to attain its oval-like shape (as shown in FIGS. 2A-3B). Additionally, in embodiments, the edge tube 121 bonds to the first layer 112 and the second layer 118 of the paddle 100 during the curing process.

The edge portion 120 may provide additional strength, stability, and/or balance to the paddle 100 or portions thereof. The edge portion 120 may also be helpful to contain the material from the core portion 115 when the material (e.g., foam) tends to expand outwardly during manufacturing.

In embodiments described herein, the core portion 115 includes a reinforcing member (indicated by reference character 114 in FIGS. 2A-2C, indicated by reference character 116 in FIGS. 3A and 3B, indicated as reference character 140 in FIGS. 9A-9C, and indicated by reference character 160 in FIGS. 10-10D) or a core composite therein.

In embodiments, the reinforcing member 114, 116, 140, 160, or at least portions thereof, is made from a woven or non-woven composite fiber material including fibers impregnated with resin, such as epoxy, polyester, and/or metal matrix resins. For instance, the material may include any fiber-reinforced composite (including fiber-reinforced polymers, fiber-reinforced plastics, etc.). In embodiments, the reinforcing member 114, 116, 140, 160 is made from the same material as the first layer 112 and the second layer 118. Additionally, the reinforcing member 114, 116, 140, 160 may be in the form of a sheet of material that is folded, bent, rolled, woven, molded, braided, etc. in a particular orientation, as discussed below.

The reinforcing member 114, 116, 140, 160 extends between the first layer 112 and the second layer 118, and is in contact with each of the first layer 112 and the second layer 118. For instance, the reinforcing member 114, 116, 140, 160 is bonded to the first layer 112 and the second layer 118. The bonding may be accomplished by a resin, such as a thermosetting resin (e.g., an epoxy or polyester resin), a thermoplastic resin, etc. While the resin cures, the resin is configured to flow, to fully disperse, and/or to impregnate the matrix of fibers of the inner surfaces 113, 117 of the first layer 112 and the second layer 118, respectively, and the matrix of fibers of the reinforcing member 114, 116, 140, 160, for example. The reinforcing member 114, 116, 140, 160 is configured to provide strength in the vertical direction (as viewed in FIGS. 2A-3B, for instance; parallel to the thickness "t" dimension) and/or to minimize the amount of deflection in response to a force (e.g., contacting a pickleball ball) being applied to the first layer 112 or the second layer 118.

As shown in FIGS. 2A-10D, the reinforcing member 114, 116, 140, 160 can extend between the first layer 112 and the second layer 118 in a variety of orientations.

Figure 2A:
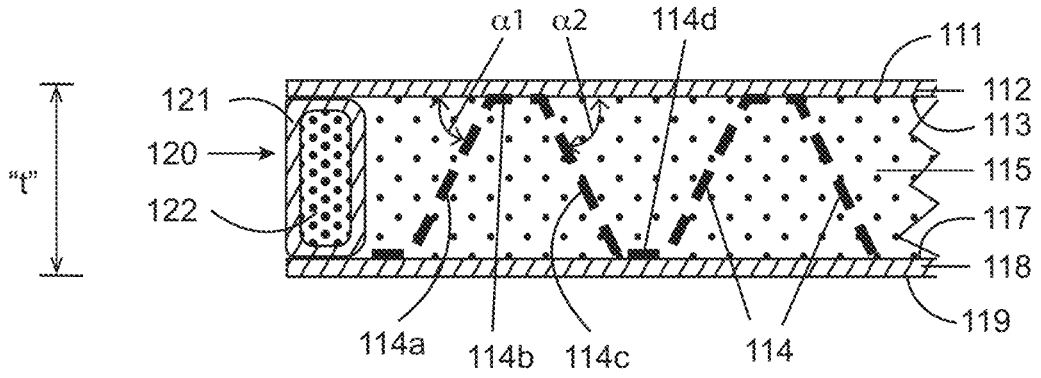
FIGS. 2A-3B are schematic, cross-sectional views of a portion of the pickleball paddle taken along line B-B in FIG. 1 shown with an edge guard separated therefrom in FIG. 2B in accordance with various embodiments of the present disclosure.

With particular reference to FIG. 2A, the reinforcing member 114 forms a trapezoidal shape including a first leg 114*a* disposed at a first angle $\alpha 1$ relative to the first layer 112, a second leg 114*b* extending along (e.g., in contact with) the first layer 112, a third leg 114*c* disposed at a second angle $\alpha 2$ relative to the first layer 112, and a fourth leg 114*d* disposed along (e.g., in contact with) the second layer 118. In embodiments, the first angle $\alpha 1$ and the second angle $\alpha 2$ are equal to each other and are between about 25° and about 75° (e.g., equal to about) 50°; other angles are also envisioned and incorporated by the present disclosure. Additionally, in embodiments, the second leg 114*b* and the fourth leg 114*d* may be equal to each other in length (i.e., in the direction along the first layer 112 and the second layer 118, respectively), and may define a length of between about 1 mm and about 20 mm (e.g., equal to about 5 mm). While the intersections between adjacent legs 114*a*, 114*b*, 114*c*, 114*d* are shown as forming sharp angles, any or all of these intersections may be rounded, e.g., to facilitate manufacturing.

Figure 2B:
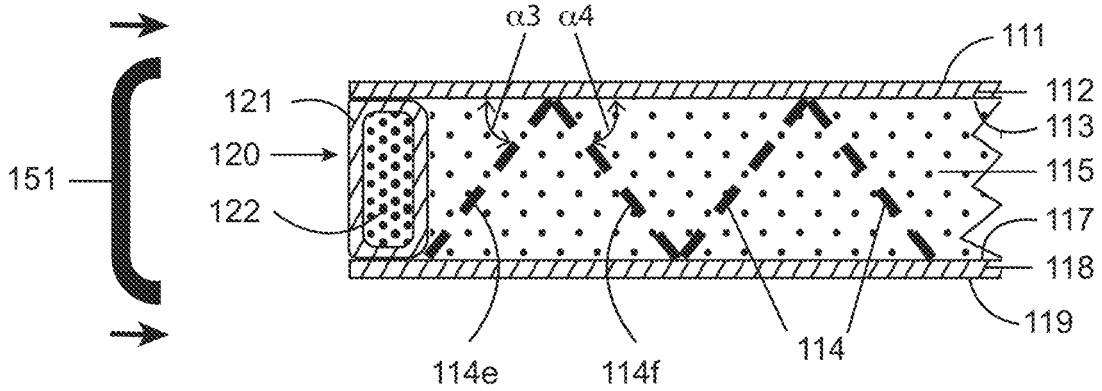

With specific reference to FIG. 2B, the reinforcing member 114 forms a triangular shape including a first leg 114*e* disposed at a third angle $\alpha 3$ relative to the first layer 112, and a second leg 114*f* disposed at a fourth angle α4 relative to the first layer 112. In embodiments, the third angle α3 and the fourth angle α4 are equal to each other and are between about 20° and about 75° (e.g., equal to about 45°). In this embodiment, the intersections between adjacent legs 114*e* and 114*f* (at the first layer 112 and the second layer 118) are decipherable (e.g., by look and/or feel) through the respective first layer 112 and the second layer 118, and may be perceived to resemble strings of a tennis racquet (parallel to axis "A-A"), which may help a consumer decide to purchase such a pickleball paddle 100. This feature may also result in a textured surface to help a user generate spin, for instance.

While the intersections between adjacent legs 114*c* and 114*f* are shown as forming sharp angles, any or all of these intersections may be rounded, e.g., to facilitate manufacturing.

Figure 2C:
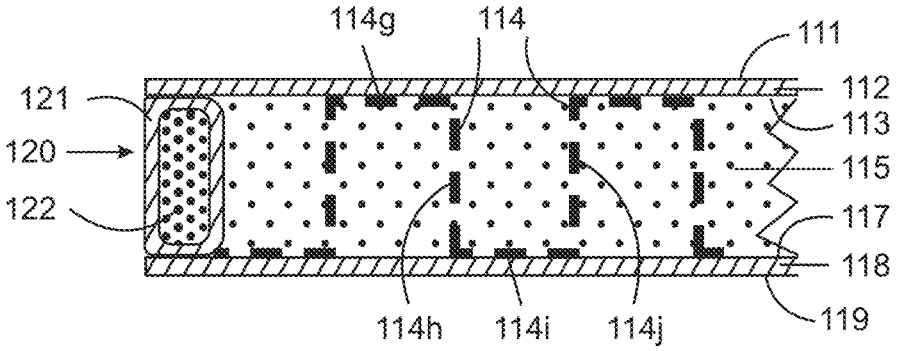

Referring now to FIG. 2C, the reinforcing member 114 forms a rectangular- or stepped-shape including a first leg 114*g*, a second leg 114*h*, a third leg 114*i*, and a fourth leg 114*j*. The first leg 114*g* is disposed along (and in contact with) the first layer 112, the second leg 114*h* is perpendicular to the first leg 114*h*, the third leg 114*i* is perpendicular to the second leg 114*h* and is disposed along (and in contact with) the second layer 118, and the fourth leg 114*j* is perpendicular to the third leg 114*i*.

In FIGS. 2A-2C, the reinforcing member 114 is shown as a grid structure. As used herein, the term "grid" or "grid structure" encompasses various grid, grid-like, and mesh patterns/designs, for instance, where spaces are defined between adjacent portions of the grid. The grid structure may form a plurality of polygons and/or a plurality of round shapes. That is, the reinforcing member 114 in FIGS. 2A-2C defines a plurality of open spaces. The open spaces within the reinforcing member 114 reduce the overall weight of the pickleball paddle 100. Additionally, in disclosed embodiments, while the overall weight of the pickleball paddle 100 is decreased, which is generally desirable by players, the strength of the pickleball paddle 100 (e.g., in the vertical direction) is not compromised.

Additionally, the open spaces within the grid structure of the reinforcing member 114 allow the material (e.g., foam) of the core portion 115 on a first side (e.g., left side) of the reinforcing member 114 to contact and effectively merge or fuse with the material on a second side (e.g., right side) of the reinforcing member 114 (e.g., during curing). The merging or fusing of part of the core portion 115 with another part of the core portion 115 may help further strengthen the pickleball paddle 100.

Figure 3A:
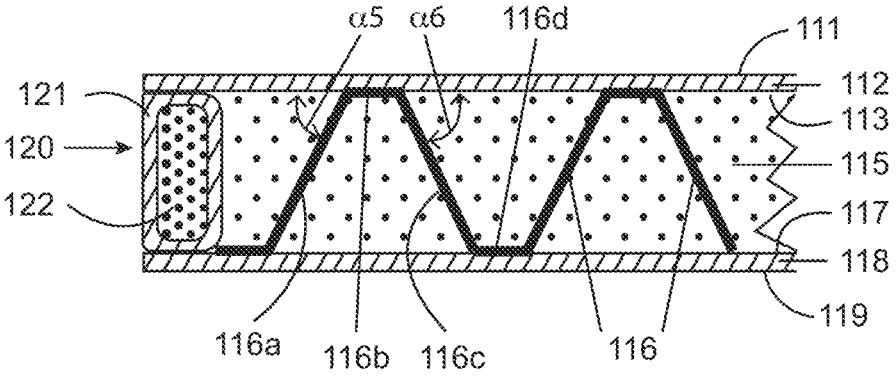
Figure 3B:
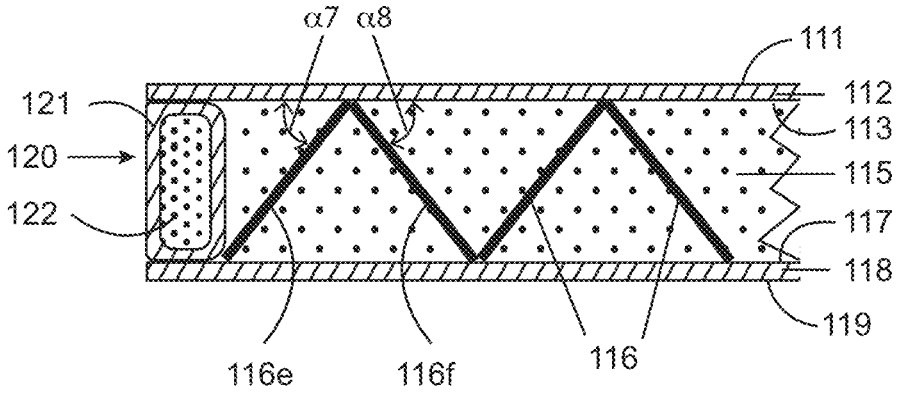

In FIGS. 3A and 3B, the reinforcing member 116 is shown as a sheet material. In contrast to the grid structure of the reinforcing member 114 of FIGS. 2A-2C, the sheet material of the reinforcing member 116 of FIGS. 3A and 3B does not define open spaces.

With particular reference to FIG. 3A, the reinforcing member 116 forms a trapezoidal shape including a first leg 116*a* disposed at a fifth angle α5 relative to the first layer 112, a second leg 116*b* extending along (e.g., in contact with) the first layer 112, a third leg 116*c* disposed at a sixth angle α6 relative to the first layer 112, and a fourth leg 116*d* disposed along (e.g., in contact with) the second layer 118. In embodiments, the fifth angle α5 and the sixth angle α6 are equal to each other and are between about 25° and about 75° (e.g., equal to about) 50°; other angles are also envisioned and incorporated by the present disclosure. Additionally, in embodiments, the second leg 116*b* and the fourth leg 116*d* may be equal to each other in length (i.e., in the direction along the first layer 112 and the second layer 118, respectively), and may define a length of between about 1 mm and about 20 mm (e.g., equal to about 5 mm). While the intersections between adjacent legs 116*a*, 116*b*, 116*c*, 116*d* are shown as forming sharp angles, any or all of these intersections may be rounded, e.g., to facilitate manufacturing.

With specific reference to FIG. 3B, the reinforcing member 116 forms a triangular shape including a first leg 116*e* disposed at a seventh angle α7 relative to the first layer 112, and a second leg 116*f* disposed at an eighth angle α8 relative to the first layer 112. In embodiments, the seventh angle α7 and the eighth angle α8 are equal to each other and are between about 20° and about 75° (e.g., equal to about 45°). In this embodiment, the intersections between adjacent legs 116*e* and 116*f* (at the first layer 112 and the second layer 118) are decipherable (e.g., by look and/or feel) through the respective first layer 112 and the second layer 118, and may be perceived to resemble strings of a tennis racquet (parallel to axis "A-A"), which may help a consumer decide to purchase such a pickleball paddle 10. This feature may also result in a textured surface to help a user generate spin, for instance.

While the intersections between adjacent legs 116*e* and 116*f* are shown as forming sharp angles, any or all of these intersections may be rounded, e.g., to facilitate manufacturing.

Additionally, while not explicitly shown in the accompanying figures, the reinforcing member 116 may be oriented in other ways such as the rectangular- or stepped-shape shown in FIG. 2C with relation to reinforcing member 114. Moreover, additional orientations (e.g., different shapes or a combination of shapes) of reinforcing members 114, 116 are also contemplated by the present disclosure.

In embodiments, the reinforcing member 114, 116, 140, 160 is formed from a high strength material such as carbon, such as a particular grade of carbon fiber (e.g., T700, T800, 3K, 6K, 12K, 18K). Alternatively or additionally, fibers of the reinforcing member 114, 116, 140, 160 can be made from glass, graphite, Kevlar, graphene, boron, and combinations thereof, for instance. The reinforcing member 114, 116, 140, 160 can be formed from multiple plies (e.g., two or three unidirectional carbon fiber plies overlaid with offset axes). The material(s) making up the reinforcing member 114, 116, 140, 160 can be the same as or different from the material(s) making up the first layer 112 and the second layer 118. Further, the material(s) making up the reinforcing member 114, 116, 140, 160 can be any suitable fiber-reinforced composite (including fiber-reinforced polymers, fiber-reinforced plastics, etc.). The strength of the material of the reinforcing member 114, 116, 140, 160 helps strengthen, balance, and minimize deflection at various locations of the head portion 110 of the paddle 100.

In addition to the edge portion 120, the paddle 100 may also include an edge guard 151 (FIG. 2B). The edge guard 151 is applied to the edge portion 120 and helps protect the edge portion 120, and the portions of the paddle 100 adjacent thereto. The edge guard 151 may also help provide additional weight and/or balance to the paddle 100, for instance. In embodiments the edge guard 151 is removable from the remainder of the paddle 100 and is replaceable with a different edge guard 151. While the edge guard 151 is only shown in FIG. 2B, all embodiments disclosed herein may include the edge guard 151.

Figure 4A:
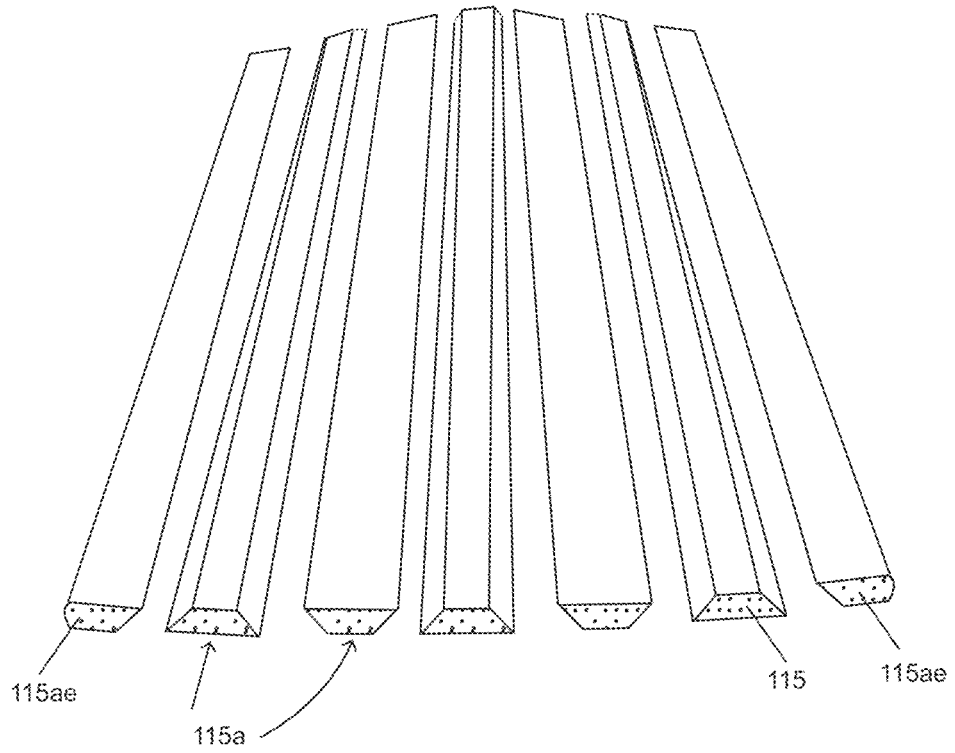
FIGS. 4A and 4B are perspective views of a plurality of strips of a core portion of the pickleball paddle of FIG. 1 in accordance with various embodiments of the present disclosure.
Figure 4B:
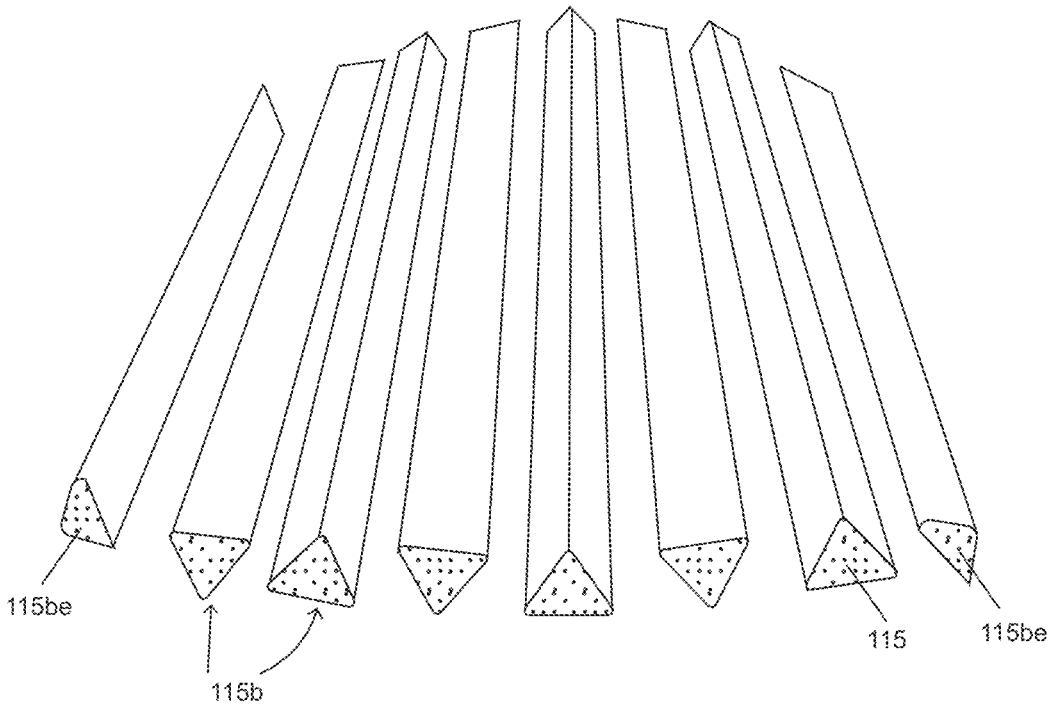

Referring now to FIGS. 4A and 4B, a plurality of strips of the core portion 115 is shown. In FIG. 4A, the core portion 115 is shown in a plurality of trapezoidal strips 115*a*. In FIG. 4B, the core portion 115 is shown in a plurality of triangular strips 115*b*. The trapezoidal strips 115*a* of FIG. 4A are usable with the embodiments shown in FIGS. 2A and 3A where the reinforcing member 114, 116 is shown as being orientated in a trapezoidal pattern. The triangular strips 115*b* of FIG. 4B are usable with the embodiments shown in FIGS. 2B and 3B where the reinforcing member 114, 116 is shown as being oriented in a triangular pattern. In embodiments the strips 115*a*, 115*b* are manufactured or molded in the particular shapes. In other embodiments, the strips 115*a*, 115*b* are manufactured or molded into sheets (e.g., rectangular prisms) and are then cut into the particular shapes. As shown, end strips 115*ae*, 115*be* are slightly different in shape than their adjacent strips 115*a*, 115*b*, respectively, to enable the perimeter of the core portion 115 to be generally vertical, for instance.

Figure 5A:
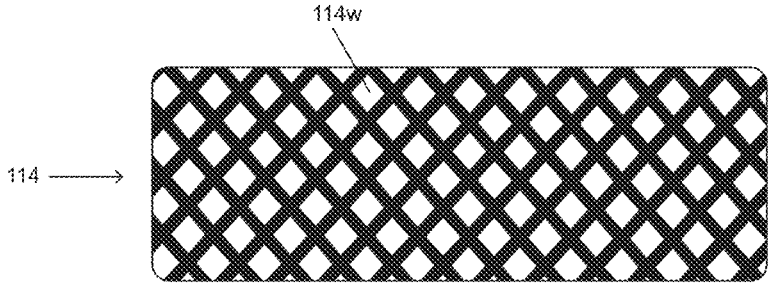
FIGS. 5A-5D are top views of various patterns of a reinforcing member of the core portion of the pickleball paddle of FIG. 1 in accordance with various embodiments of the present disclosure.
Figure 5B:
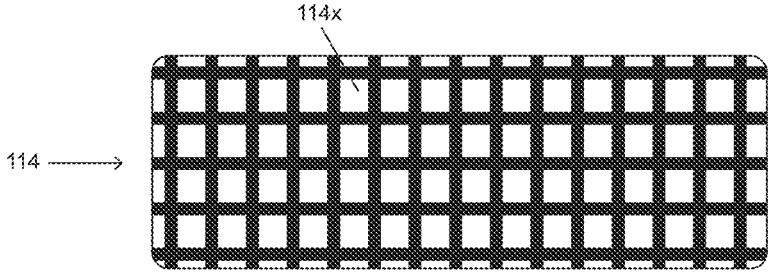
Figure 5C:
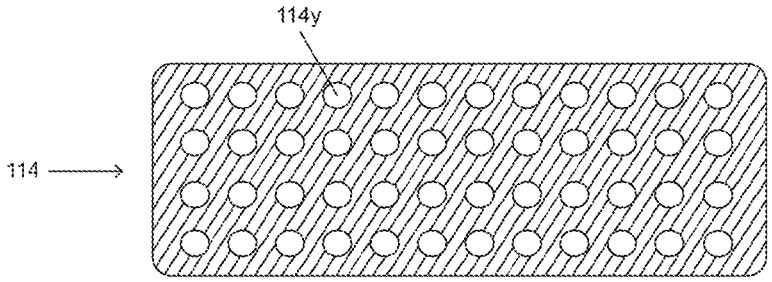
Figure 5D:
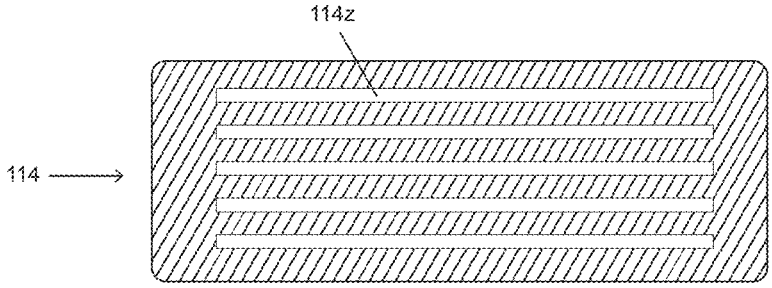

With reference to FIGS. 5A-5D, various embodiments of the reinforcing member 114 having different grid structures are shown. In FIG. 5A, the reinforcing member 114 defines a grid structure having a plurality of diamond-shaped openings 114*w*. In FIG. 5B, the reinforcing member 114 defines a grid structure having a plurality of rectangular openings 114*x*. In FIG. 5C, the reinforcing member 114 defines a grid structure having a plurality of circular openings 114*y*. In FIG. 5D, the reinforcing member 114 defines a grid structure having a plurality of elongated rectangular openings 114*z*. Reinforcing members 114 having either of these openings 114*w*, 114*x*, 114*y*, 114*z* are usable in the embodiments of the reinforcing member 114 having a grid structure disclosed herein.

Moreover, depending on the particular embodiment, the open spaces or openings 114*w*-1142 defined between adjacent portions of the grid structure of the reinforcing member 114 make up between about 1% and about 99% of the total area of the solid portions of the reinforcing member 114. For instance, in FIG. 5A, the open spaces 114*w* defined between adjacent portions of the reinforcing member 114 may be between about 50% and about 75% of the total area of the reinforcing member 114. In FIG. 5B, the open spaces 114*x* defined between adjacent portions of the reinforcing member 114 may be between about 60% and about 85% of the total area of the reinforcing member 114. In FIG. 5C, the open spaces 114*y* defined between adjacent portions of the reinforcing member 114 may be between about 15% and about 45% of the total area of the reinforcing member 114. In FIG. 5D, the open spaces 114*z* defined between adjacent portions of the reinforcing member 114 may be between about 5% and about 35% of the total area of the reinforcing member 114.

Further, the embodiments illustrated in FIGS. 5A-5D are only examples of different types of grid structures; reinforcing members 114 having other types of grid structures are also encompassed by the present disclosure.

The reinforcing member 114, 116, 140, 160 may help provide the paddle 100 with desired strength, stiffness and/or flexibility, and the core portion 115 (e.g., foam) may result in a desirable amount of strength, speed, and noise reduction (versus a plastic core, for instance).

The present disclosure also includes methods of assembling and/or manufacturing the paddle 100, or components thereof. Various steps in the assembly and/or manufacturing process of the paddle 100 are described with reference to FIGS. 6A-8C.

Figure 6A:
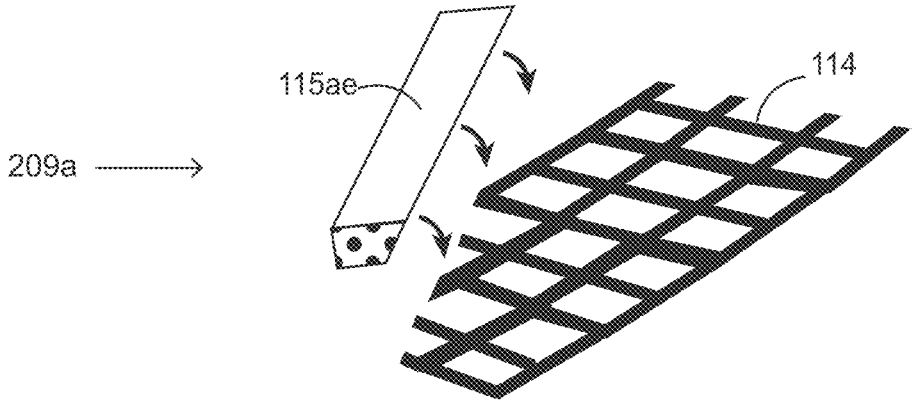
FIGS. 6A-6C are schematic, assembly views of a part of a first core assembly of the pickleball paddle of FIG. 1 in accordance with an embodiment of the present disclosure.
Figure 6B:
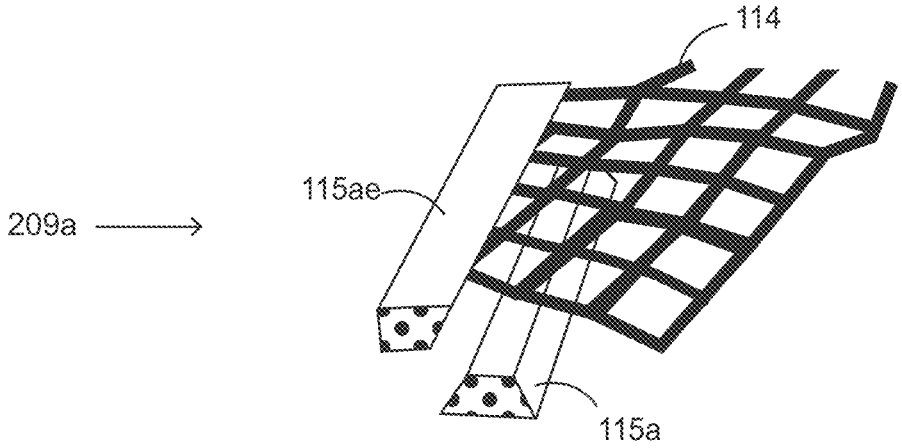
Figure 6C:
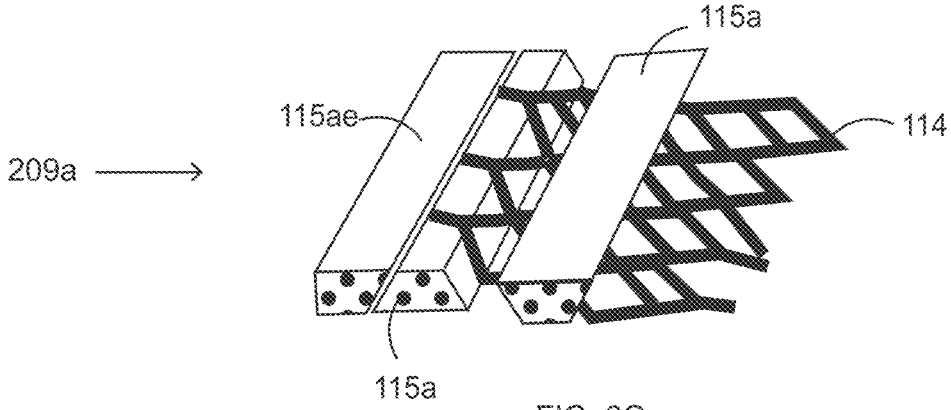
Figure 7A:
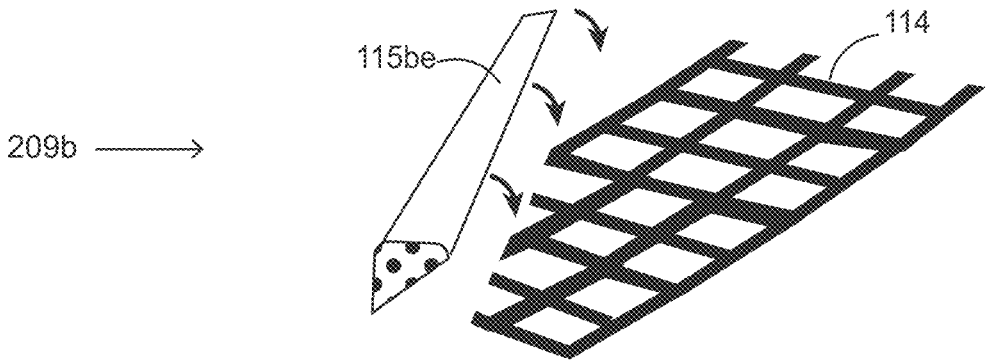
FIGS. 7A-7C are schematic, assembly views of a part of a second core assembly of the pickleball paddle of FIG. 1 in accordance with an embodiment of the present disclosure.
Figure 7B:
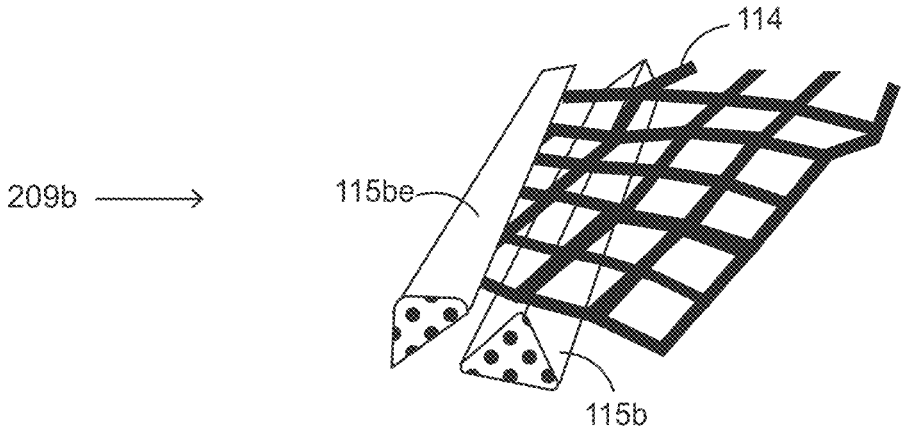
Figure 7C:
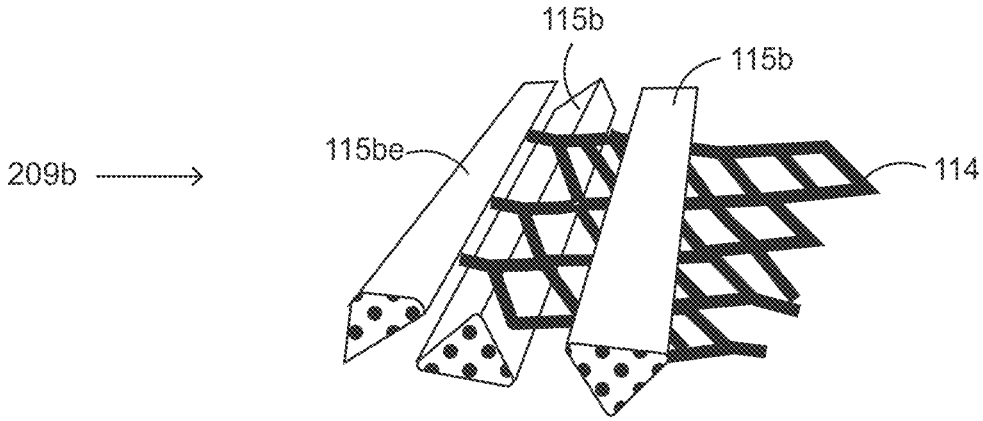

Initially, FIGS. 6A-6C show the formation of a first core assembly 209*a*, and FIGS. 7A-7C show the formation of a second core assembly 209*b*. For clarity, the first core assembly 209*a* and the second core assembly 209*b* are collectively referred to as the core assembly 209 (see FIGS. 8A-8C).

In FIGS. 6A-6C, the first core assembly 209*a* is constructed by effectively wrapping the reinforcing member 114 around portions of the strips 115*a* and the end strips 115*ac* (only a single end strip 115*ac* and two other strips 115*a* are shown in FIGS. 6A-6C for clarity). Moreover, the reinforcing member 114 is positioned in contact with the end strip 115*ac* (FIG. 6A), is wrapped over the adjacent strip 115*a* (FIG. 6B), and is wrapped under the adjacent strip 115*a* (FIG. 6C). This over-under wrapping of the reinforcing member 114 continues until all strips 115*a* and the other end strip 115*ac* are in contact with the reinforcing member 114, thereby forming the first core assembly 209*a*. Additionally, as shown in FIG. 6C, adjacent strips 115*a* are rotated or offset 180° from each other (also see FIG. 4A).

In FIGS. 7A-7C, the second core assembly 209*b* is constructed by effectively wrapping the reinforcing member 114 around portions of the strips 115*b* and the end strips 115*be* (only a single end strip 115*be* and two other strips 115*b* are shown in FIGS. 7A-7C for clarity). Moreover, the reinforcing member 114 is positioned in contact with the end strip 115*be* (FIG. 7A), is wrapped over the adjacent strip 115*b* (FIG. 7B), and is wrapped under the adjacent strip 115*b* (FIG. 7C). This over-under wrapping of the reinforcing member 114 continues until all strips 115*b* and the other end strip 115*be* are in contact with the reinforcing member 114, thereby forming the second core assembly 209*b*. Additionally, as shown in FIG. 7C, adjacent strips 115*b* are rotated or offset 180° from each other (also see FIG. 4B).

Figure 8A:
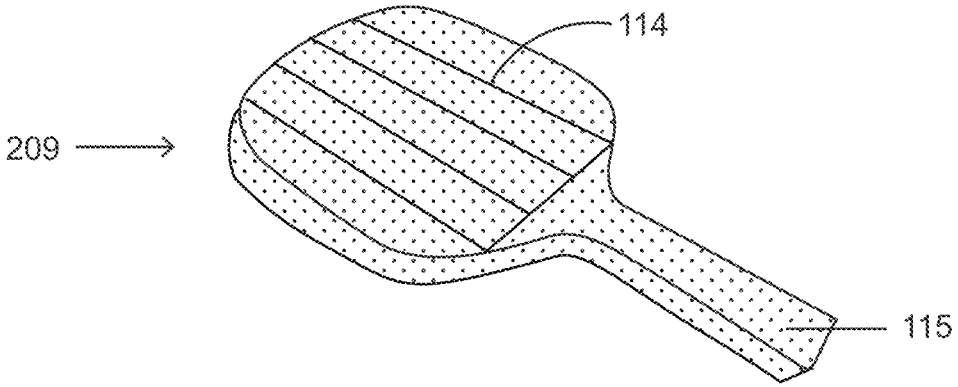
FIGS. 8A-8C are schematic illustrations of various steps of forming the structure of the pickleball paddle of FIG. 1 in accordance with embodiments of the present disclosure.
Figure 8B:
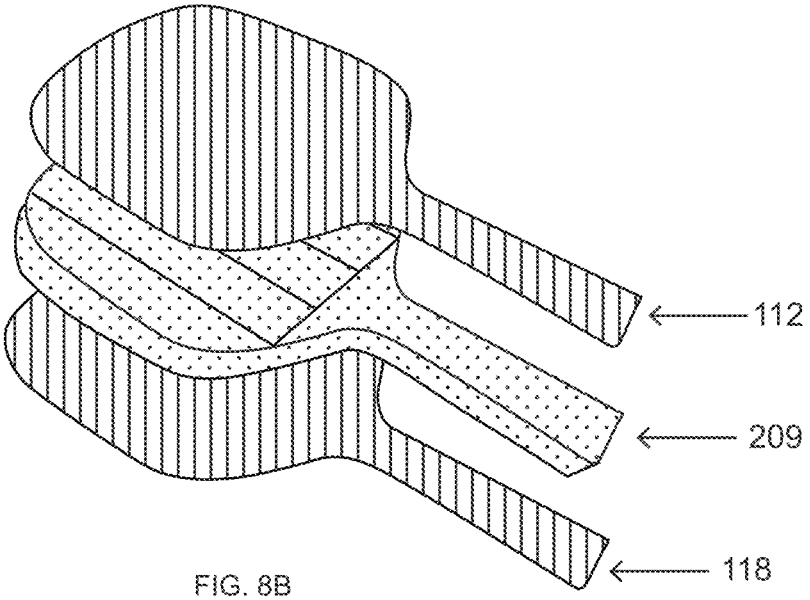
Figure 8C:
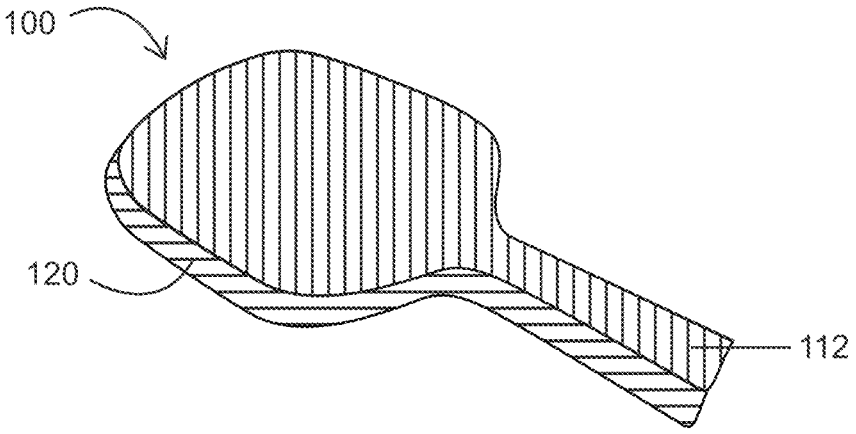

Referring now to FIGS. 8A-8C, various steps during the assembly process of the paddle 100 are illustrated. In FIG. 8A, the core assembly 209, including the core portion 115 and the reinforcing member 114, is shown. The core assembly 209 has been cut to the appropriate size and shape.

Next, as shown in FIG. 8B, the first and second layers 112, 118 are positioned onto the core assembly 209. The first layer 112 can be formed by using carbon fiber plies that are impregnated with resin (e.g., epoxy) and laminated (e.g., by hand). In embodiments, three unidirectional carbon fiber prepreg plies or sheets are used for the first layer 112 and the second layer 118.

Alternatively, the first layer 112 and the second layer 118 can be prefabricated. An example of a prefabrication process is described herein. Three plies of unidirectional carbon fiber prepregs in the rectangular shape are laid on top of one another in alternating perpendicular directions. A common dimension used in the industry is 500 mm by 600 mm. Carbon fiber prepregs may include carbon fiber ply that have been pre-impregnated with epoxy resin. The three unidirectional carbon fiber prepreg plies are positioned such that the first sheet has its fibers along the "A-A" axis, the second sheet has its fibers along the "B-B" axis, and the third sheet has its fibers along the "A-A" axis again. Further, a peel ply can be placed on the outer most layer.

Three plies of unidirectional carbon fiber prepregs, along with the peel ply, are placed into a hot press molding machine. The upper mold is aligned with the lower mold symmetrically and the mold halves are closed. Pressure is applied using hydraulic presses while the mold is cured at high temperature for a certain amount of time. While curing, the epoxy resin is configured to flow and fully disperse and impregnate the matrix of fibers (e.g., carbon fibers). After the cooling cycle, the (carbon) fiber-reinforced composite facesheet is removed from the mold. This results in a prefabricated facesheet. The prefabricated facesheet is then cut into the shape of a paddle. This is then used as the first layer 112 and the second layer 118.

Next, with reference to FIG. 8C, the edge portion 120 is positioned along at least a portion of the perimeter of the paddle 100. As discussed above, the edge portion 120 includes the edge tube 121 and the edge foam 122.

After the edge portion 120 is in its position, the entire paddle 100 is placed into a lower mold cavity. After the lower mold has been filled, the upper mold is aligned with the lower mold, symmetrically, and is tightened to close the mold. The mold is then placed into an oven or furnace at a high temperature for a certain amount of time to cure. While curing, the resin (if used) is configured to flow and fully disperse and impregnate the matrix of fibers of the first layer 112, the second layer 118, and/or the reinforcing member 114. Further, when foam is used for the core portion 115, the foam material expands as a result of it being heated. The foam then disperses helps ensure that all of the layers (i.e., the first layer 112, the second layer 118, the core assembly 209), and the edge portion 120 are securely fastened together.

Another embodiment of the pickleball paddle 100 is shown in FIGS. 9A-9C. In FIG. 9A, the core portion 115 of the head portion 110 of the pickleball paddle 100 is shown. The core portion 115 includes a plurality of holes 150 extending therethrough (in the vertical direction as viewed in FIGS. 9B and 9C. While each hole of the plurality of holes 150 is shown having a particular shape and size, the present disclosure also encompasses non-uniform holes, and holes of different sizes and shapes than those shown. Also, the spacing of the plurality of holes 150 may be uniform, as shown, or may be non-uniform. For instance, the spacing of adjacent holes may be smaller at and near the center of the head portion 110, and larger the closer to the perimeter of the head portion 110, or vice versa, depending on desired areas of strength, flexibility, stiffness, etc. Additionally, the amount of holes included in the plurality of holes 150 may be more or fewer than the amount shown.

With particular reference to FIGS. 9B and 9C, reinforcing members 140 are inserted into the plurality of holes 150. More particularly, one reinforcing member 140 including a sleeve 155 and a filling 156, is inserted into each hole of the plurality of holes 150. In embodiments, the sleeve 155 is made from the same or similar material as the first layer 112 and the second layer 118, such as a high tensile strength material such as carbon fiber prepreg plies, carbon (e.g., T700, T800, 3K, 6K, 12K or 18K carbon fiber), etc. Alternatively, the sleeve 155 can be formed of other materials such as glass, graphite, Zylon, Nylon, Aramid, Arylate, Kevlar®, graphene, boron and combinations thereof. Further, any suitable fiber-reinforced composite can be used.

Additionally, in embodiments, the filling 156 is made from the same or similar material as the core portion 115, such as foam.

Moreover, in embodiments (such as the embodiment shown in FIG. 9C), the sleeve 155 of the reinforcing member 140 includes an upper lip 157 and a lower lip 159. The upper lip 157 covers the top of the filling 156, extends radially outwardly of the sleeve 155, and is in contact with the first layer 112 of the head portion 110. The lower lip 159 covers the bottom of the filling 156, extends radially outwardly of the sleeve 155, and is in contact with the second layer 118 of the head portion 110. In embodiments, the upper lip 157 and the lower lip 159 are made from the same material as the sleeve 155 and are connected to the sleeve 155.

Referring now to FIGS. 10A-10D, another embodiment of the pickleball paddle 100 is shown. In FIGS. 10A and 10B, the core portion 115 of the head portion 110 of the pickleball paddle 100 is shown. Here, the core portion 115 includes the reinforcing member 160 woven therethrough. In embodiments, the reinforcing member 160 is made from a strand of material (e.g., a linear or a braided strand) such as the same or similar material as the first layer 112 and the second layer 118, such as a high tensile strength material such as carbon (e.g., T700, T800, 3K, 6K, 12K or 18K carbon fiber). Alternatively, the reinforcing member 160 can be formed of other materials such as glass, graphite, Zylon, Nylon, Aramid, Arylate, Kevlar®, graphene, boron and combinations thereof. Further, any suitable fiber-reinforced composite can be used.

In embodiments, the reinforcing member 160 can be knitted or threaded through pre-made holes in the core portion 115, or the reinforcing member 160 can be threaded or sewn through the core portion 115 (without pre-made holes). The reinforcing member 160 can be a single, continuous thread, or the reinforcing member 160 can be made from a plurality of threads.

As shown in FIG. 10D, each section 160*i* of the reinforcing member 160 of this embodiment includes a first leg 160*j*, a second leg 160*k*, and a third leg 160*m*. The first leg 160*k* extends along an upper surface of the core 115 and in contact with the inner surface 113 of the first layer 112, the third leg 160*m* extends along a lower surface of the core 115 and is contact with the inner surface 117 of the second layer 118, and the second leg 160*k* interconnects the first leg 160*j* and the third leg 160*m*, and extends through the core portion 115 (e.g., in a direction perpendicular to the first layer 112).

Referring back to FIGS. 10A-10C, the spacing between adjacent sections 160*i* of the reinforcing member 160 may be uniform, as shown, or may be non-uniform. For instance, the spacing of adjacent sections 160*i* may be smaller at and near the center of the head portion 110, and larger the closer to the perimeter of the head portion 110, or vice versa, depending on desired areas of strength, flexibility, stiffness, etc. Additionally, the number of sections 160*i* may be more or fewer than the amount shown. Further, while FIGS. 10A and 10B show two different orientations of the sections 160*i* of the reinforcing member 160, other orientations (e.g., diagonal) are also encompassed by the present disclosure.

With reference to FIGS. 11-16C, other embodiments of a pickleball paddle (or "paddle") are shown in connection with the present disclosure and are generally referenced by numeral 1000. Various similarities exist between paddle 100 and paddle 100; not all similarities will be discussed in detail for clarity and conciseness.

Figure 11:
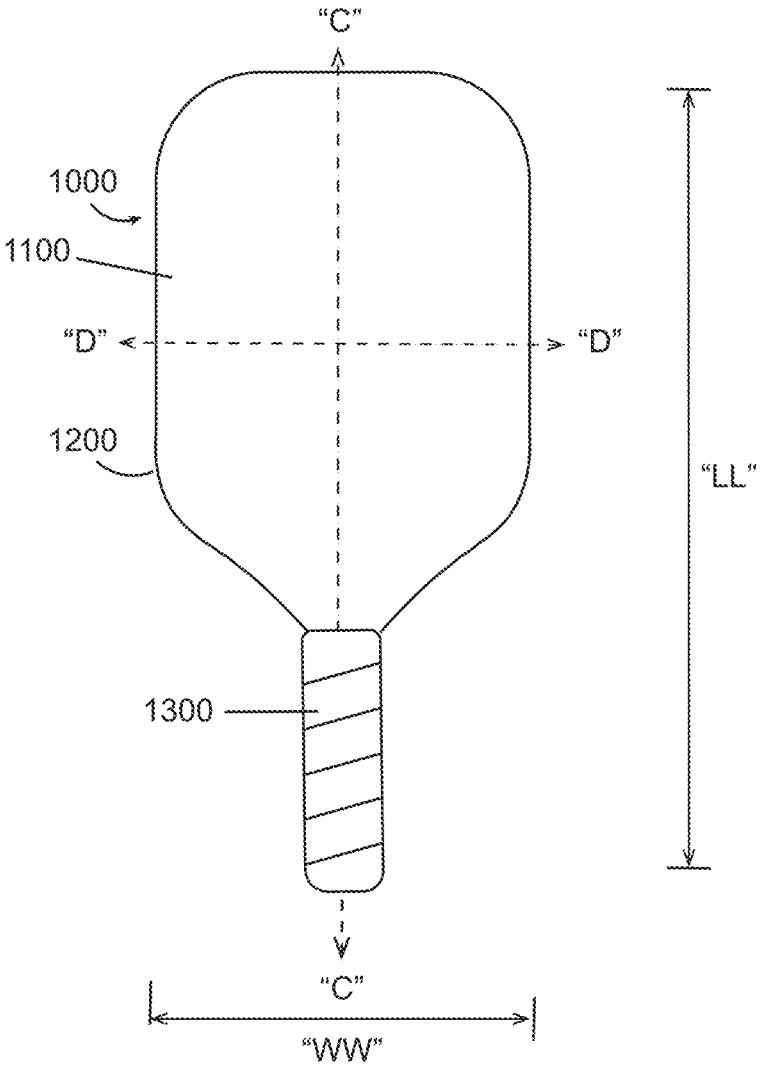
FIG. 11 is a front view of a pickleball paddle in accordance with embodiments of the present disclosure.

As shown in FIG. 11, the paddle 1000 includes a head portion 1100 coupled to a handle portion 1300. Generally, the length "LL" of the paddle 1000 may be between 15 inches and 17 inches, and the combined length plus width "WW" of the paddle 1000 may not exceed 24 inches. The present disclosure also contemplates paddles 1000 having larger and/or smaller dimensions for the length "LL" and width "WW." Additionally, while the head portion 1100 is shown having a rectangular shape with rounded corners, a head portion 1100 having other shapes, such as oval, isometric, round, teardrop, for example, is encompassed by the present disclosure. With continued reference to FIG. 11, the paddle 1000 defines a longitudinal axis "C-C" extending through the handle portion 1300, and a latitudinal axis "D-D" extending perpendicularly to the longitudinal axis "C-C."

Figure 12A:
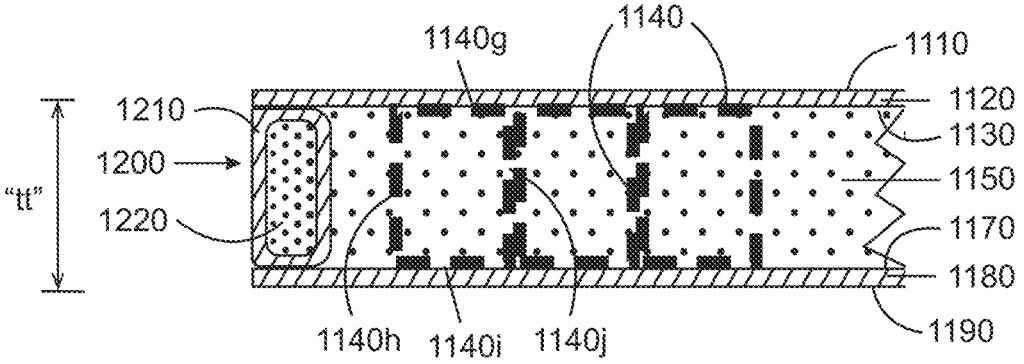
FIGS. 12A-12C are schematic, cross-sectional views of a portion of the pickleball paddle taken along line D-D in FIG. 11 shown with an edge guard separated therefrom in FIG. 12B in accordance with various embodiments of the present disclosure.
Figure 12B:
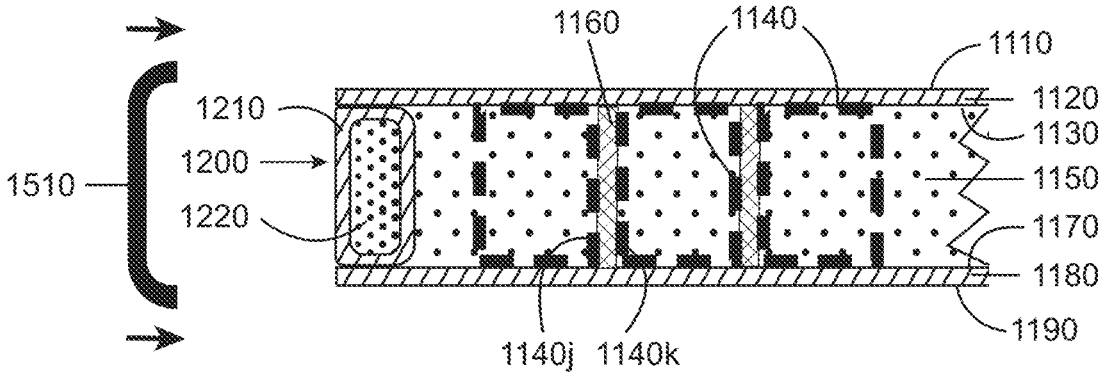
Figure 12C:
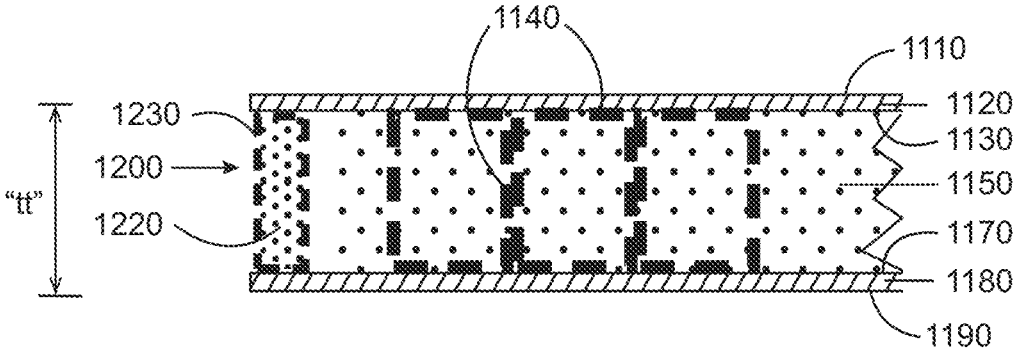

Referring now to FIGS. 12A-12C, schematic cross-sectional views of a portion of the head portion 1100 of the paddle 1000 of FIG. 11 are shown in accordance with various embodiments of the present disclosure. The cross-sections are taken along the latitudinal axis "D-D." Here, the head portion 1100 of the paddle 1000 includes a first or top layer 1120, a second or bottom layer 1180, a core portion 1150, and an edge portion 1200. In embodiments, the thickness "tt" (see FIG. 12A) of the head portion 1100, measured between an upper surface 1110 of the first layer 1120 and a lower surface 1190 of the second layer 1180, is between about 10 mm and about 20 mm. Additionally, the head portion 1100 can define a thickness "tt" that is greater than or less than this range without departing from the scope of the present disclosure.

The core portion 1150 of the paddle 1000 can be made from any suitable material that can recover its initial shape after impact, such as foam (e.g., elastomeric foam). For instance, the foam of the core portion 1150 can be open-celled (e.g., Polyurethane or "PU", natural rubber or "NR", nitrile, Ethylene-Propylene-Diene Monomer or "EPDM", Polyvinyl Chloride or "PVC", etc.) or closed-celled (e.g., Ethyl-Vinyl Acetate or "EVA", neoprene, Styrene-Butadiene Rubber or "SBR", Thermoplastic Polyurethane or "TPU", Expanded Thermoplastic Polyurethane or "ETPU", etc.). The foam may also be thermoplastic or thermoset. Further, the core portion 1150 can be made from any combination of the disclosed materials or other materials, and may include a multi-layer structure.

Various embodiments of the core portion 1150 and the edge portion 1200 of the paddle 1000 are shown in the accompanying figures. While certain combinations of the different embodiments of the core portion 1150 and the edge portion 1200 are shown, other combinations are also encompassed by the present disclosure.

Additionally, while it is contemplated that embodiments of the paddle 1000 include the first layer 1120 being different from the second layer 1180, the embodiments described herein include each paddle 1000 having the first layer 1120 being the same as the second layer 1180. For clarity, when one of the first layer 1120 or the second layer 1180 is described herein with regard to a particular embodiment, the other of the first layer 1120 or the second layer 1180 in the same embodiment is identical or substantially identical.

Generally, the first layer 1120, the second layer 1180, and the core portion 1150 form a sandwiched structure.

In each of the embodiments shown in FIGS. 12A-12C, the first layer 1120 includes the outer surface 1110 and an inner surface 1130, and the second layer 1180 includes the outer surface 1190 and an inner surface 1170. In embodiments, each of the first layer 1120 and the second layer 1180 is made from a woven or non-woven composite fiber material including fibers impregnated with resin, such as epoxy, polyester, and/or metal matrix resins. For instance, the material may include any fiber-reinforced composite (including fiber-reinforced polymers, fiber-reinforced plastics, etc.). Additionally, the material of each of the first layer 1120 and the second layer 1180 can include multiple layers of material (e.g., where adjacent layers include 45°, 90°, etc. offset grain orientation, for instance).

In disclosed embodiments, the outer surfaces 1110, 1190 of the respective first layer 1120 and the second layer 1180 have a roughened texture. The roughened texture can be formed by grit, sand, and/or other particles applied to, or positioned under one or more coatings applied to the outer surfaces 1110, 1190.

Another way of forming a roughened texture is by applying an additional layer of a fabric material, such as a peel ply fabric, on the outer surfaces 1110, 1190. In embodiments, the peel ply fabric is a woven fabric, nylon, or polyester, which, during the cure cycle of the manufacturing process, absorbs some of the matrix epoxy resin, for instance, and becomes an integral part of the laminate of each layer 1120, 1180. Following the cure cycle, the peel ply fabric is peeled off or otherwise removed from the first layer 1120 and the second layer 1180, which fractures the resin between the peel ply fabric and the outer surfaces 1110, 1190, respectively, and which leaves a fresh, clean, roughened surface of matrix epoxy resin. A further way of forming a roughened texture is by making the outer surfaces 1110, 1190 from woven, high-grade raw carbon fiber, other fibrous materials, and/or combinations thereof.

In disclosed embodiments, a ply of planar fiber material is first cut into the shape of the mold corresponding to the shape of the pickleball paddle 1000. The fibers can be co-axially aligned in sheets or layers, braided, or weaved in sheets or layers, and/or chopped and randomly dispersed in one or more layers. In a multiple layer construction, the fibers can be aligned in different directions with respect to the longitudinal axis "C-C" of the paddle 1000, and/or in braids or weaves from layer to layer. The fibers may be formed of a high tensile strength material such as carbon (e.g., T700, T800, 3K, 6K, 12K or 18K carbon fiber). Alternatively, the fibers can be formed of other materials such as glass, graphite, Zylon, Nylon, Aramid, Arylate, Kevlar®, graphene, boron and combinations thereof. Further, any suitable fiber-reinforced composite can be used.

A roughened texture on the outer surfaces 1110, 1190 may be useful to some pickleball players by generating a relatively large amount of friction (as opposed to a smooth surface) may making contact with the ball. This roughened texture and increased friction can help a player generate spin, and create an increased amount of angular momentum resulting in the ball travelling with higher angular velocities.

Alternatively, the outer surfaces 1110, 1190 of the paddle 1000 can be smooth, and not roughened or textured, which may be preferred by some players.

With continued reference to FIGS. 12A-12B, the edge portion 1200 of the paddle 1000 is shown. An edge foam 1220 is positioned within an edge tube 1210, which extends along the perimeter of the head portion 1100 of the pickleball paddle 1000. The edge tube 1210 interconnects the first layer 1120 and the second layer 1180, and may be made from a fiber-reinforced composite, such as the same material that the first layer 1120 and the second layer 1180 are made from.

With continued reference to FIG. 12C, the edge portion 1200 of the paddle 1000 is shown. The edge foam 1220 is positioned within an edge grid structure 1230, which extends along the perimeter of the head portion 1100 of the pickleball paddle 1000. The edge grid structure 1230 interconnects the first layer 1120 and the second layer 1180. As used herein, the term "grid" encompasses various grid, grid-like, and mesh patterns/designs, for instance, where spaces are defined between adjacent portions of the grid. In embodiments, the edge grid structure 1230 is formed from a high strength material such as carbon, such as a particular grade of carbon fiber (e.g., T700, T800, 3K, 6K, 12K, 18K). Alternatively or additionally, the fibers of the edge grid structure 1230 can be made from glass, graphite, Kevlar, graphene, and combinations thereof, for instance. The edge grid structure 1230 can be formed from multiple plies (e.g., two unidirectional carbon fiber plies overlaid with offset axes). The material(s) making up the edge grid structure 1230 can be the same as or different from the material(s) making up the first layer 1120 and the second layer 1180. Further, the material(s) making up the edge grid structure can be any suitable fiber-reinforced composite (including fiber-reinforced polymers, fiber-reinforced plastics, etc.). The strength of the material of the edge grid 1230 helps strengthen, balance, and minimize deflection at and near the perimeter of the paddle 1000.

The edge foam 1220 is at least partially encapsulated by the edge tube 1210 or the edge grid structure 1230, and is made from either the same material used to make the core portion 1150, or from a different material. For instance, the edge foam 1220 can be open-celled (e.g., Polyurethane or "PU", natural rubber or "NR", nitrile, Ethylene-Propylene-Diene Monomer or "EPDM", Polyvinyl Chloride or "PVC", etc.) or closed-celled (e.g., Ethyl-Vinyl Acetate or "EVA", neoprene, Styrene-Butadiene Rubber or "SBR", Thermoplastic Polyurethane or "TPU", Expanded Thermoplastic Polyurethane or "ETPU", etc.). The edge foam 1220 may also be thermoplastic or thermoset.

In embodiments, the edge foam 1220 cures and expands within the edge tube 1210 or edge grid structure 1230, thereby allowing the edge tube 1210 or edge grid structure 1230 to attain its oval-like shape (as shown in FIGS. 12A-12C). Additionally, in embodiments, the edge tube 1210 or the edge grid structure 1230 bonds to the first layer 1120 and the second layer 1180 of the paddle 1000 during the curing process.

The edge portion 1200 may provide additional strength, stability, and/or balance to the paddle 1000 or portions thereof. The edge portion 1200 may also be helpful to contain the material from the core portion 1150 when the material (e.g., foam) tends to expand outwardly during manufacturing.

In embodiments described herein, the core portion 1150 includes a reinforcing member 1140 (FIGS. 12A-12C) and a core composite therein.

In FIGS. 12A-12C, the reinforcing member 1140 is shown as a grid structure. As used herein, the term "grid" or "grid structure" encompasses various grid, grid-like, and mesh patterns/designs, for instance, where spaces are defined between adjacent portions of the grid. That is, the reinforcing member 1140 in FIGS. 12A-12C defines a plurality of open spaces. The open spaces within the reinforcing member 1140 reduce the overall weight of the pickleball paddle 1000. Additionally, in disclosed embodiments, while the overall weight of the pickleball paddle 1000 is decreased, which is generally desirable by players, the strength of the pickleball paddle 1000 (e.g., in the vertical direction) is not compromised.

Additionally, the open spaces within the grid structure of the reinforcing member 1140 allow the material (e.g., foam) of the core portion 1150 on a first side (e.g., left side) of the reinforcing member 1140 to contact and effectively merge or fuse with the material on a second side (e.g., right side) of the reinforcing member 1140 (e.g., during curing). The merging or fusing of part of the core portion 1150 with another part of the core portion 1150 may help further strengthen the pickleball paddle 1000.

In embodiments, the reinforcing member 1140 is formed from a high strength material such as carbon, such as a particular grade of carbon fiber (e.g., T700, T800, 3K, 6K, 12K, 18K). Alternatively or additionally, fibers of the reinforcing member 1140 can be made from glass, graphite, Kevlar, graphene, boron, and combinations thereof, for instance. The reinforcing member 1140 can be formed from multiple plies (e.g., two or three unidirectional carbon fiber plies overlaid with offset axes). The material(s) making up the reinforcing member 1140 can be the same as or different from the material(s) making up the first layer 1120 and the second layer 1180. Further, the material(s) making up the reinforcing member 1140 can be any suitable fiber-reinforced composite (including fiber-reinforced polymers, fiber-reinforced plastics, etc.). The strength of the material of the reinforcing member 1140 helps strengthen, balance, and minimize deflection at various locations of the head portion 1100 of the paddle 1000.

The reinforcing member 1140 extends between the first layer 1120 and the second layer 1180, and is in contact with each of the first layer 1120 and the second layer 1180. For instance, the reinforcing member 1140 is bonded to the first layer 1120 and the second layer 1180. The bonding may be accomplished by a resin, such as a thermosetting resin (e.g., an epoxy or polyester resin), a thermoplastic resin, etc. While the resin cures, the resin is configured to flow, to fully disperse, and/or to impregnate the matrix of fibers of the inner surfaces 1130, 1170 of the first layer 1120 and the second layer 1180, respectively, and the matrix of fibers of the reinforcing member 1140, for example. The reinforcing member 1140 is configured to provide strength in the vertical direction (as viewed in FIGS. 12A-12C, for instance; parallel to the thickness "tt" dimension) and/or to minimize the amount of deflection in response to a force (e.g., contacting a pickleball ball) being applied to the first layer 1120 or the second layer 1180.

Referring now to FIG. 12A, the reinforcing member 1140 forms a rectangular- or stepped-shape including a first leg 1140*g*, a second leg 1140*h*, a third leg 1140*i*, and a fourth leg 1140*j*. The first leg 1140*g* is disposed along (and in contact with) the first layer 1120, the second leg 1140*h* is perpendicular to the first leg 1140*g*, the third leg 1140*i* is perpendicular to the second leg 1140*h* and is disposed along (and in contact with) the second layer 1180, and the fourth leg 1140*j* is perpendicular to the third leg 1140*i*. While the intersections between adjacent legs 1140*g* and 1140*h* are shown as forming sharp angles, any or all of these intersections may be rounded, e.g., to facilitate manufacturing.

Referring now to FIG. 12B, an interconnect member 1160 is positioned between the first leg 1140*j* of a first reinforcing member 1140, and a second leg 1140*k* of an adjacent reinforcing member 1140, and is made from either the same material used to make the core portion 1150, or from a different material. For instance, the interconnect member 1160 can be open-celled (e.g., Polyurethane or "PU", natural rubber or "NR", nitrile, Ethylene-Propylene-Diene Monomer or "EPDM", Polyvinyl Chloride or "PVC", etc.) or closed-celled (e.g., Ethyl-Vinyl Acetate or "EVA", neoprene, Styrene-Butadiene Rubber or "SBR", Thermoplastic Polyurethane or "TPU", Expanded Thermoplastic Polyurethane or "ETPU", etc.). The interconnect member 1160 may also be thermoplastic or thermoset. The width of the interconnect member 1160 can be the same or different than the width of the reinforcing member 1140.

In addition to the edge portion 1200, the paddle 1000 may also include an edge guard 1510 (FIG. 12B). The edge guard 1510 is applied to the edge portion 1200 and helps protect the edge portion 1200 and the portions of the paddle 1000 adjacent thereto. The edge guard 1510 may also help provide additional weight and/or balance to the paddle 1000, for instance. In embodiments the edge guard 1510 is removable from the remainder of the paddle 1000 and is replaceable with a different edge guard 1510. While the edge guard 1510 is only shown in FIG. 12B, all embodiments disclosed herein may include the edge guard 1510.

Figure 13:
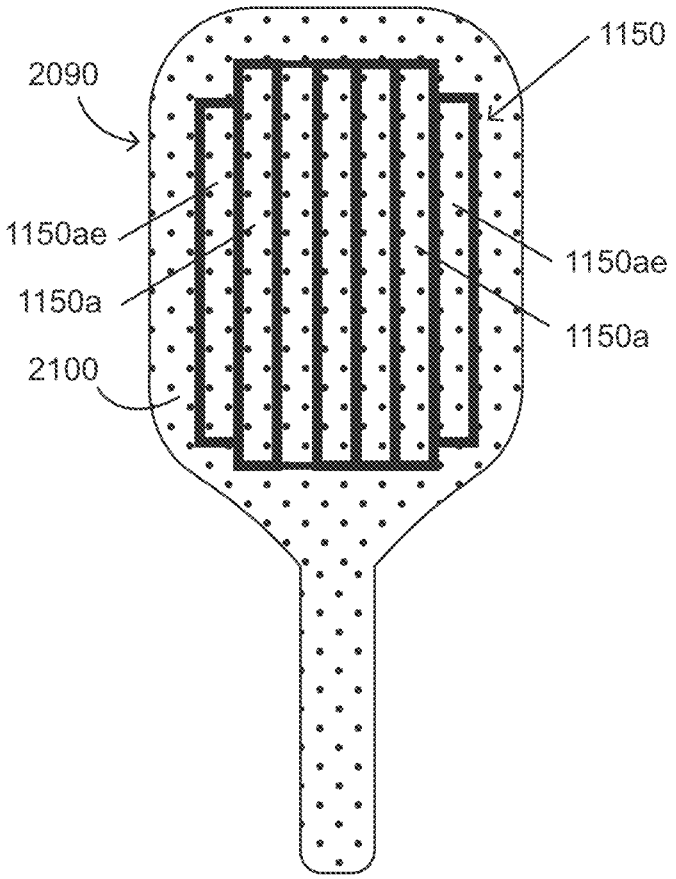
FIG. 13 is a schematic view of the core assembly of the pickleball paddle of FIGS. 11, 12A, 12B, and/or 12C in accordance with various embodiments of the present disclosure.

Referring now to FIG. 13, the core assembly 2090 is shown. The core assembly 2090 comprises a surrounding foam 2100, and a core portion 1150. The surrounding foam 2100 is made from either the same material used to make the core portion 1150, or from a different material. For instance, the surrounding foam 2100 can be open-celled (e.g., Polyurethane or "PU", natural rubber or "NR", nitrile, Ethylene-Propylene-Diene Monomer or "EPDM", Polyvinyl Chloride or "PVC", etc.) or closed-celled (e.g., Ethyl-Vinyl Acetate or "EVA", neoprene, Styrene-Butadiene Rubber or "SBR", Thermoplastic Polyurethane or "TPU", Expanded Thermoplastic Polyurethane or "ETPU", etc.). The surrounding foam 2100 may also be thermoplastic or thermoset. The surrounding foam 2100 extends through the handle portion 1300.

Figure 14A:
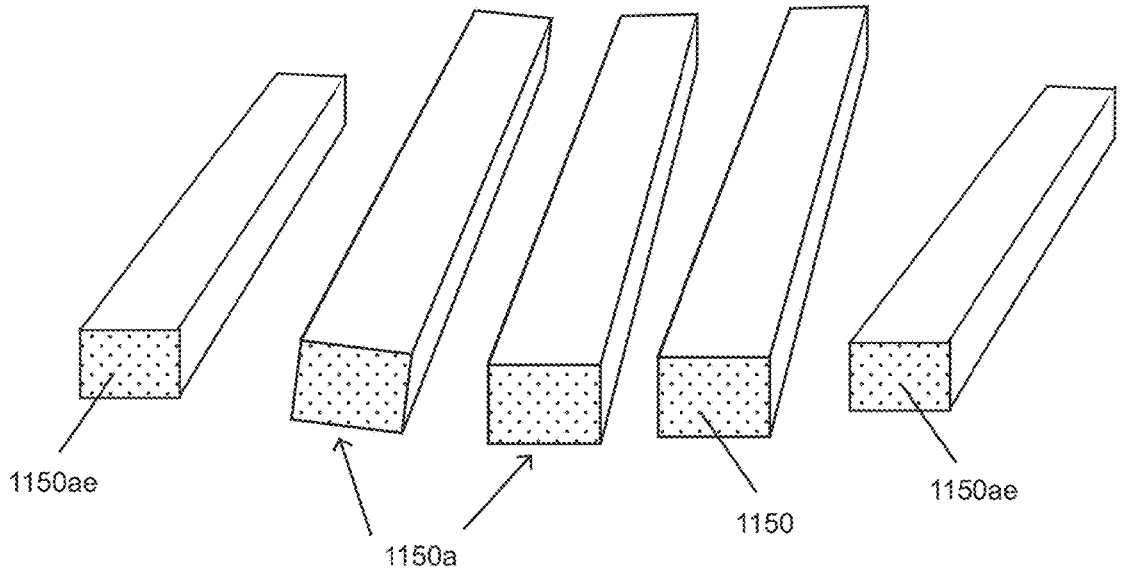
FIGS. 14A and 14B are perspective views of a plurality of strips of the core assembly of FIG. 13 in accordance with various embodiments of the present disclosure.
Figure 14B:
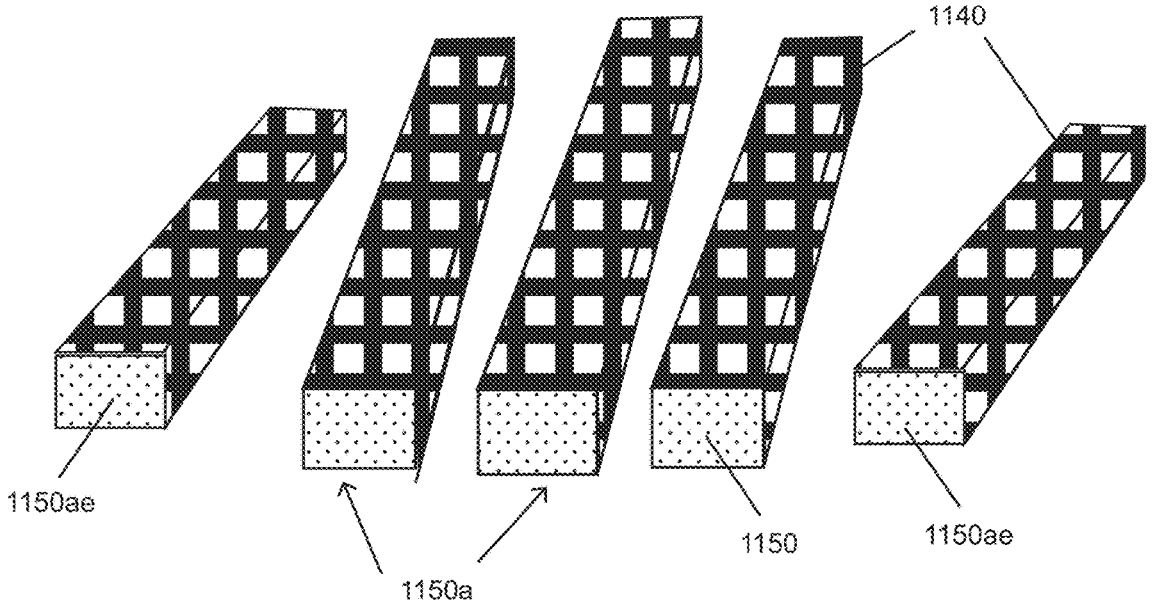

Referring now to FIGS. 14A-14B, the core portion 1150 comprises a plurality of rectangular prisms or rectangular strips 1150*a*. Each rectangular strip 1150*a* may be of the same length as each other or of varying lengths. The outermost rectangular strips 1150*ae* may be of a shorter length to accommodate the difference in length in the paddle 1000. The core assembly 2090 is constructed by effectively placing the rectangular strips 1150*a*, 1150*ac* within the surrounding foam 2100 (e.g., within a recess or pocket in the surrounding foam 2100). While FIG. 13 illustrates seven rectangular strips (including strips 1150*a* and 1150*ae*), the core portion 1150 may include more or fewer than seven rectangular strips. For instance, the core portion 1150 may include between three strips and sixteen strips.

With particular reference to FIG. 14B, each rectangular strip 1150*a*, 1150*ae* is wrapped with the reinforcing member 1140. The rectangular strips 1150*a* of FIG. 14A are usable with the embodiments shown in FIGS. 12A-12C where the reinforcing member 1140 is shown as being orientated in a rectangular shape. In embodiments, the rectangular strips 1150*a* are manufactured or molded in the particular shapes, and may be cut to a desired length, for example. Additionally, the ends of the rectangular strips 1150*a* may be curved, rounded or angled to substantially match the contours of the perimeter of the head portion 1200 of the paddle 1000. As used herein, the term "rectangular prism" is intended to describe not only precise rectangular prisms, but also rectangular strips where one or both ends are curved, rounded or angled.

Figure 15A:
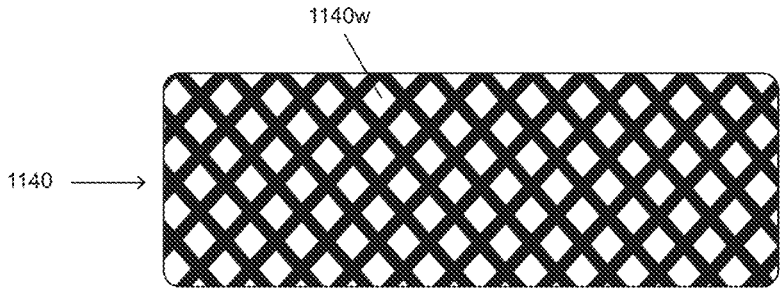
FIGS. 15A-15D are top views of various patterns of a reinforcing member of the core portion of the pickleball paddle of FIG. 11 in accordance with various embodiments of the present disclosure.
Figure 15B:
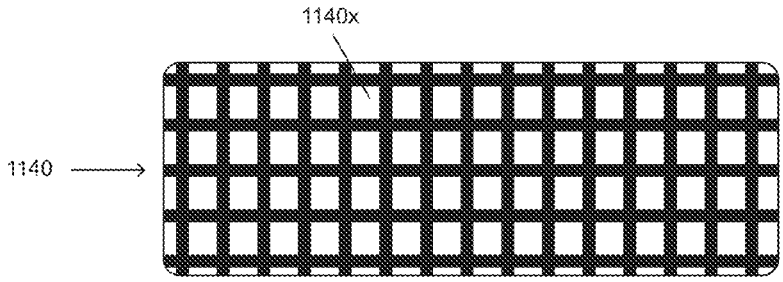
Figure 15C:
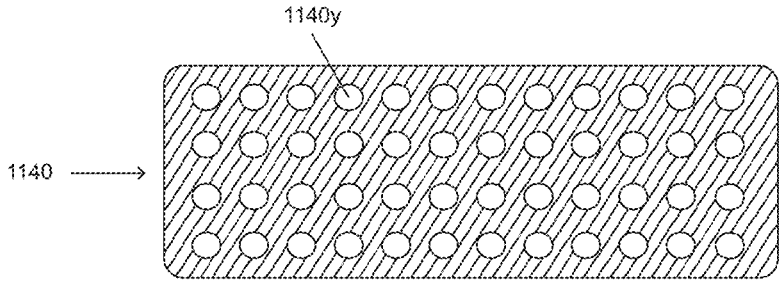
Figure 15D:
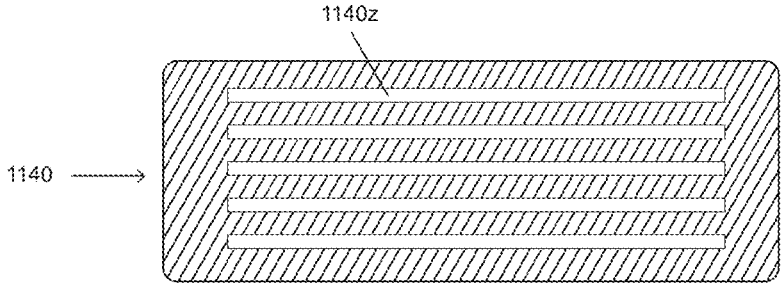

With reference to FIGS. 15A-15D, various embodiments of the reinforcing member 1140 and the edge grid structure 1230 having different grid structures are shown. In FIG. 15A, the reinforcing member 1140 and the edge grid structure 1230 define a grid structure having a plurality of diamond-shaped openings 1140*w*. In FIG. 15B, the reinforcing member 1140 and the edge grid structure 1230 define a grid structure having a plurality of rectangular openings 1140*x*. In FIG. 15C, the reinforcing member 1140 and the edge grid structure 1230 define a grid structure having a plurality of circular openings 1140*y*. In FIG. 15D, the reinforcing member 1140 and the edge grid structure 1230 define a grid structure having a plurality of elongated rectangular openings 1140*z*. The reinforcing members 1140 and the edge grid structure 1230 having either of these openings 1140*w*, 1140*x*, 1140*y*, 1140*z* are usable in the embodiments of the reinforcing member 1140 and the edge grid structure 1230 having a grid structure disclosed herein.

Moreover, depending on the particular embodiment, the open spaces or openings 1140*w*-1140*z* defined between adjacent portions of the grid structure of the reinforcing member 1140 and the edge grid structure 1230 make up between about 1% and about 99% of the total area of the solid portions of the reinforcing member 1140 and the edge grid structure 1230. For instance, in FIG. 15A, the open spaces 1140*w* defined between adjacent portions of the reinforcing member 1140 and the edge grid structure 1230 may be between about 50% and about 75% of the total area of the reinforcing member 1140 and the edge grid structure 1230. In FIG. 15B, the open spaces 1140*x* defined between adjacent portions of the reinforcing member 1140 and the edge grid structure 1230 may be between about 60% and about 85% of the total area of the reinforcing member 1140 and the edge grid structure 1230. In FIG. 15C, the open spaces 1140*y* defined between adjacent portions of the reinforcing member 1140 and the edge grid structure 1230 may be between about 15% and about 45% of the total area of the reinforcing member 1140 and the edge grid structure 1230. In FIG. 15D, the open spaces 1140*z* defined between adjacent portions of the reinforcing member 1140 and the edge grid structure 1230 may be between about 5% and about 35% of the total area of the reinforcing member 1140 and the edge grid structure 1230.

Further, the embodiments illustrated in FIGS. 15A-15D are only examples of different types of grid structures; the reinforcing members 1140 and the edge grid structure 1230 having other types of grid structures are also encompassed by the present disclosure.

The reinforcing member 1140 may help provide the paddle 1000 with desired strength, stiffness and/or flexibility, and the core portion 1150 (e.g., foam) may result in a desirable amount of strength, speed, and noise reduction (versus a plastic core, for instance).

Figure 16A:
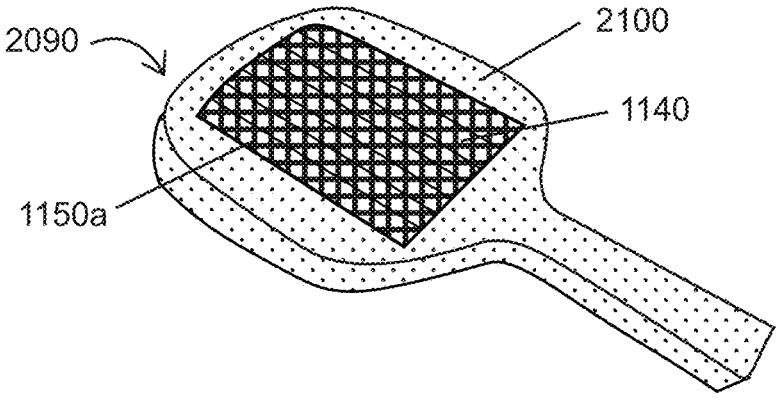
FIGS. 16A-16C are schematic illustrations of various steps of forming the structure of the pickleball paddle of FIG. 11 in accordance with embodiments of the present disclosure.

The present disclosure also includes methods of assembling and/or manufacturing the paddle 1000, or components thereof. Various steps in the assembly and/or manufacturing process of the paddle 1000 are described with reference to FIGS. 16A-16C. In FIG. 16A, the core assembly 2090, including the core portion 1150, the rectangular strips 1150*a*, and the reinforcing member 1140, is shown. The rectangular strips 1150*a* have been wrapped with the reinforcing member 1140, and have been positioned within the recess of the surrounding foam 2100 of the core portion 1150. The core assembly 2090 has been cut to the appropriate size and shape.

Figure 16B:
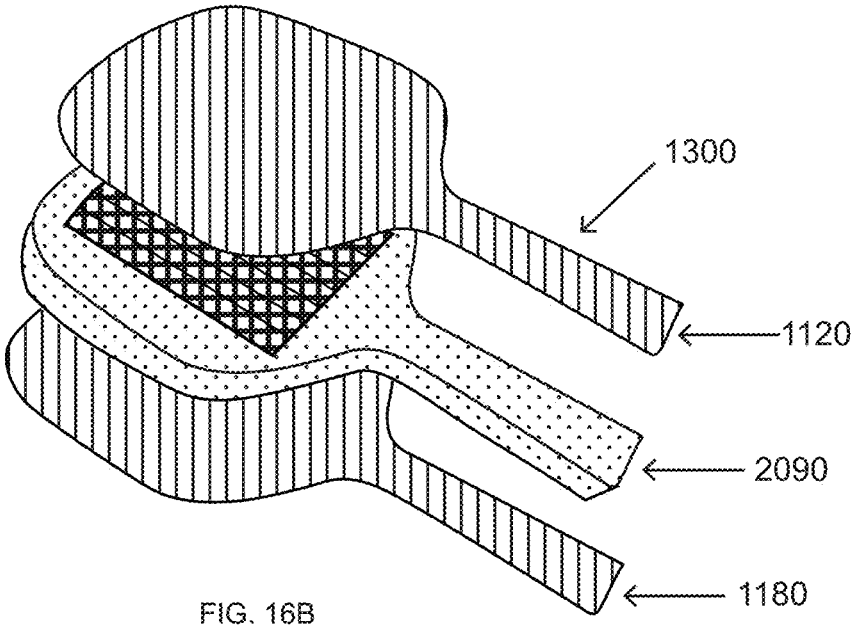

Next, as shown in FIG. 16B, the first and second layers 1120, 1180 are positioned onto the core assembly 2090. The first and second layers 1120, 1180 extend to the handle portion 1300. The first layer 1120 and the second layer 1180 can be formed by using carbon fiber plies that are impregnated with resin (e.g., epoxy) and laminated (e.g., by hand). In embodiments, three unidirectional carbon fiber prepreg plies or sheets are used for the first layer 1120 and the second layer 1180.

Alternatively, the first layer 1120 and the second layer 1180 can be prefabricated. An example of a prefabrication process is described herein. Three plies of unidirectional carbon fiber prepregs in the rectangular shape are laid on top of one another in alternating perpendicular directions. A common dimension used in the industry is 500 mm by 600 mm. Carbon fiber prepregs may include carbon fiber ply that have been pre-impregnated with epoxy resin. The three unidirectional carbon fiber prepreg plies are positioned such that the first sheet has its fibers along the "C-C" axis, the second sheet has its fibers along the "D-D" axis, and the third sheet has its fibers along the "C-C" axis again. Further, a peel ply can be placed on the outer most layer.

Three plies of unidirectional carbon fiber prepregs, along with the peel ply, are placed into a hot press molding machine. The upper mold is aligned with the lower mold symmetrically and the mold halves are closed. Pressure is applied using hydraulic presses while the mold is cured at high temperature for a certain amount of time. While curing, the epoxy resin is configured to flow and fully disperse and impregnate the matrix of fibers (e.g., carbon fibers). After the cooling cycle, the (carbon) fiber-reinforced composite facesheet is removed from the mold. This results in a prefabricated facesheet. The prefabricated facesheet is then cut into the shape of the paddle 1000, and is used as the first layer 1120 and the second layer 1180.

Figure 16C:
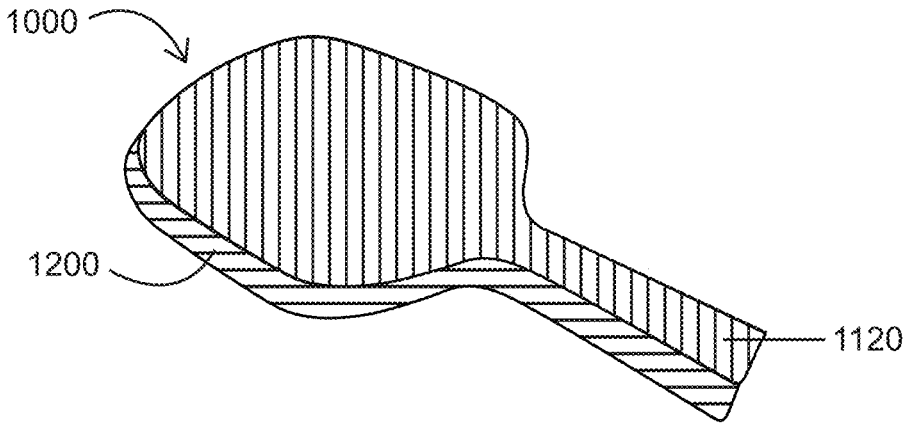

Next, with reference to FIG. 16C, the edge portion 1200 is positioned along at least a portion of the perimeter of the paddle 1000. As discussed above, the edge portion 1200 includes the edge tube 1210 and the edge foam 1220.

After the edge portion 1200 is in its position, the entire paddle 1000 is placed into a lower mold cavity. After the lower mold has been filled, the upper mold is aligned with the lower mold, symmetrically, and is tightened to close the mold. The mold is then placed into an oven or furnace at a high temperature for a certain amount of time to cure. While curing, the resin (if used) is configured to flow and fully disperse and impregnate the matrix of fibers of the first layer 1120, the second layer 1180, and/or the reinforcing member 1140. Further, when foam is used for the core portion 1150, the foam material expands as a result of it being heated. The foam then disperses helps ensure that all of the layers (i.e., the first layer 1120, the second layer 1180, and the core assembly 2090), and the edge portion 1200 are securely fastened together.

The embodiments described herein result in better absorption of the impact energy of the paddle 100, 1000 hitting the ball, increase the duration of the ball in contact with the paddle 100, 1000, and/or provide greater angular momentum imparted on the ball when the paddle 100, 1000 rolls over the ball. Further, by adjusting the grid pattern and shape, the thickness and density of the various layers, and the angle of the reinforcing member 114, 116, 140, 160, 1140 relative to the first layer 112, 1120 and the second layer 118, 1180 the mechanical properties of the paddle 100, 1000 will be changed accordingly. For instance, the strength and stiffness of the paddle 100, 1000 can be tailored by adjusting any or all of these parameters to provide different amount of power, spin, and control levels to meet the needs of various playing styles.

Various other embodiments of pickleball paddles are described in International Patent Application Number PCT/US23/30143, filed on Aug. 14, 2023, the entire contents of which are incorporated herein by reference.

It will be understood that various modifications may be made to the embodiments disclosed herein. Therefore, the above description should not be construed as limiting, but merely as exemplifications of various embodiments. Those skilled in the art will envision other modifications within the scope and spirit of the claims appended hereto.

The invention claimed is:

1. A pickleball paddle, comprising:

a handle portion; and a head portion operably connected to the handle portion, the head portion including:

a core portion including a plurality of strips, wherein at least one strip of the plurality of strips has a cross-section that is a rectangle, the core portion defining an edge, a first surface, and a second surface;

a first layer disposed adjacent the first surface of the core portion, the first layer made from a first material;

a second layer disposed adjacent the second surface of the core portion, the second layer made from the first material; and a reinforcing member disposed within the core portion and in contact with the first layer and the second layer, the reinforcing member including a grid structure defining a plurality of open spaces.

2. The pickleball paddle according to claim 1, wherein the core portion includes foam disposed within the plurality of open spaces defined by the reinforcing member.

3. The pickleball paddle according to claim 1, wherein a first section of the reinforcing member is oriented at a perpendicular angle relative to the first layer.

4. The pickleball paddle according to claim 1, wherein the core portion includes foam, and wherein foam on a first side of the reinforcing member is in direct contact with foam on a second side of the reinforcing member.

5. The pickleball paddle according to claim 1, wherein the reinforcing member is made from a fiber-reinforced composite.

6. The pickleball paddle according to claim 1, wherein the grid structure forms at least one of a plurality of polygons or a plurality of round shapes.

7. The pickleball paddle according to claim 1, wherein each strip of the plurality of strips has a cross-section that is a rectangle.

8. The pickleball paddle according to claim 1, wherein the cross-section of the at least one strip is taken along a width of the head portion, and wherein the width of the head portion is in a direction that is perpendicular to the handle portion.

9. The pickleball paddle according to claim 1, wherein the least one strip of the plurality of strips has a cross-section that is a rectangle defines defining four walls, and wherein the reinforcing member is disposed in contact with each wall of the four walls of the at least one strip of the plurality of strips.

10. The pickleball paddle according to claim 1, wherein the first material is a fiber-reinforced composite.

11. The pickleball paddle according to claim 1, further comprising an edge tube disposed along a perimeter of the head portion, the edge tube including a sleeve at least partially surrounding foam, wherein the sleeve is made from a fiber-reinforced composite.

12. The pickleball paddle according to claim 1, further comprising an edge portion disposed along a perimeter of the head portion, the edge portion including an edge grid structure made from a fiber-reinforced composite at least partially surrounding foam.

13. The pickleball paddle according to claim 1, wherein the plurality of strips includes between three strips and sixteen strips.

14. The pickleball paddle according to claim 1, wherein the head portion includes an interconnect member extending between and in contact with the first layer and the second layer, and extending between and in contact with two strips of the plurality of strips.

15. The pickleball paddle according to claim 14, wherein the interconnect member is made from a foam material.

16. A head portion of a pickleball paddle, comprising:

a core portion including a plurality of rectangular prisms;

a first layer disposed in contact with a first surface of at least one rectangular prism of the plurality of rectangular prisms, the first layer made from a first material;

a second layer disposed in contact with a second surface of the at least one rectangular prism of the plurality of rectangular prisms, the second layer made from the first material; and a reinforcing member disposed in contact with the first layer, the second layer, and with each rectangular prism of the plurality of rectangular prisms, the reinforcing member including a grid structure defining a plurality of open spaces.

17. The head portion according to claim 16, wherein each rectangular prism of the plurality of rectangular prisms is made from foam.

18. The head portion according to claim 17, wherein the reinforcing member is made from a fiber-reinforced composite.

19. The head portion according to claim 16, wherein the plurality of rectangular prisms includes between three rectangular prisms and sixteen rectangular prisms.

20. The head portion according to claim 16, wherein the reinforcing member is in contact with each of the four sides of each rectangular prism of the plurality of rectangular prisms.

* * * * *